US007391991B2

(12) United States Patent
Suda et al.

(10) Patent No.: US 7,391,991 B2
(45) Date of Patent: Jun. 24, 2008

(54) PROCESS CARTRIDGE AND IMAGE FORMING APPARATUS

(75) Inventors: Takeo Suda, Katsushika-ku (JP); Shinichi Kawahara, Katsushika-ku (JP); Takaaki Tawada, Yokohama (JP); Choutaroh Kataoka, Ota-ku (JP)

(73) Assignee: Ricoh Company, Ltd., Tokyo (JP)

( * ) Notice: Subject to any disclaimer, the term of this patent is extended or adjusted under 35 U.S.C. 154(b) by 322 days.

(21) Appl. No.: 11/070,817

(22) Filed: Mar. 3, 2005

(65) Prior Publication Data

US 2005/0196194 A1 Sep. 8, 2005

(30) Foreign Application Priority Data

Mar. 4, 2004 (JP) ..... 2004-060512
Apr. 16, 2004 (JP) ..... 2004-121093

(51) Int. Cl.
*G03G 21/16* (2006.01)

(52) U.S. Cl. ..... 399/111; 399/113

(58) Field of Classification Search ..... 399/107, 399/110, 111, 112, 113
See application file for complete search history.

(56) References Cited

U.S. PATENT DOCUMENTS 5,436,707 A * 7/1995 Ogane et al. ..... 399/111
6,519,431 B1 * 2/2003 Toba et al. ..... 399/111
2003/0016968 A1 * 1/2003 Takahashi et al. ..... 399/302
2003/0113650 A1 * 6/2003 Suwabe et al. ..... 399/176

FOREIGN PATENT DOCUMENTS

| | | |
|---|---|---|
| JP | 05-134484 | 5/1993 |
| JP | 10-074031 | 3/1998 |
| JP | 2000-132058 | 5/2000 |
| JP | 2000-147960 | 5/2000 |
| JP | 2001-201999 | 7/2001 |
| JP | 2001-249604 | 9/2001 |
| JP | 2003-241619 | 8/2003 |

OTHER PUBLICATIONS

U.S. Appl. No. 11/528,635, filed Sep. 28, 2006, Kumagai, et al.
U.S. Appl. No. 10/588,957, filed Aug. 10, 2006, Suda, et al.

* cited by examiner

*Primary Examiner*—David M. Gray
*Assistant Examiner*—Ryan D. Walsh
(74) *Attorney, Agent, or Firm*—Oblon, Spivak, McClelland, Maier & Neustadt, P.C.

(57) ABSTRACT

A process cartridge of the present invention includes a photoconductive member with a rotatable axis, a cleaning member to contact on the photoconductive member, and plates to support both ends of the rotatable axis of the photoconductive member. The plates further support the supporting member, so that the process cartridge is improved accuracy between the photoconductive member and the cleaning member. Further, an image forming apparatus of the present invention can mount the same process cartridge inside.

37 Claims, 18 Drawing Sheets

PROCESS CARTRIDGE AND IMAGE FORMING APPARATUS

BACKGROUND OF THE INVENTION

1. Field of the Invention

The present invention relates to a process cartridge and an image forming apparatus, and more specifically to the process cartridge for forming images in a copying apparatus, a facsimile apparatus, a printer or the like by an electrostatic image transfer process, and to the image forming apparatus which uses the process cartridge.

2. Discussion of the Related Art

In an image forming apparatus of the type using an electrostatic image transfer system, a process cartridge is often used. The process cartridge collectively includes a photoconductive member and a process device e.g. a charging device, a developing device, a cleaning device and the like to form an image on the photoconductive drum. The process cartridge allows a user or a service person to replace the process cartridge currently installed in the image forming apparatus with a new one if maintenance or replacement of parts is needed in the installed cartridge. In the case that a service person can maintain the image forming apparatus, the maintenance time may be shorter because maintenance can be simply done. Also, a user can replace the process cartridge with a new one when a service person is unavailable.

In such an image forming apparatus, process devices should be accurately assembled within a process cartridge to form a higher quality image. Especially, unless a cleaning blade formed by a light rubber accurately contacts a photoconductive member, the cleaning blade can not adequately remove a residual toner so that an unusual image may be formed. For example, inaccurate contact may cause an undesirable change of pressure in a length direction, a change in cleaning angle, or the like of the cleaning blade. Conventional image forming apparatus include a cleaning blade and a photoconductive drum included in a removable process cartridge. However, many of these conventional designs mount the cleaning blade in the process cartridge without consideration of the accuracy of contact between the cleaning blade and photoconductive drum.

Japanese laid-open patent publication no. 5-134484 is directed to maintaining accurate contact between a photoconductive member and a cleaning device with a cleaning blade within a process cartridge. This reference shows a cleaning blade directly connected to a support plate, which in turn is connected to a strength frame formed of sheet material. The strength frame is coupled to a shaft by way of an L shaped member. The shaft is rotationally coupled to side plates of the process cartridge, so that the cleaning blade can rotate into and out of contact with the photoconductive member. A bias spring connected to a top wall of the process cartridge is coupled to the L shaped member in order to bias the cleaning blade toward the photoconductive drum. However the present inventors have recognized that such a complex support structure of interconnected parts can diminish the accuracy of contact between the cleaning blade and photoconductive drum.

Thus, there is a strong demand in which each cleaning member, e.g. a cleaning blade, a cleaning roller and the like, further accurately contacts on a photoconductive member to improve cleaning ability.

SUMMARY OF THE INVENTION

To address the above described and/or other problems, it is an object of the present invention to provide a process cartridge configured to be detachably mounted in an image forming apparatus. First and second plates support both ends of a photoconductive member, and further support both ends of a supporting member that supports a cleaning member.

An embodiment of the present invention further provides a method for assembling a process cartridge configured to be detachably mounted in an image forming apparatus. The method includes inserting both ends of a shaft of a photoconductive member into each of first and second plates, fixing both ends of a supporting plate for a cleaning member on the first and second plates, and mounting a developing device on the first and second plates.

An embodiment of the present invention still further provides an image forming apparatus using a process cartridge. The process cartridge includes first and second plates. The first and second plates support both ends of a photoconductive member, and further support both ends of a supporting member supporting a cleaning member.

In another embodiment of the invention, the first and second plates determine a relative position of the photoconductive member and the cleaning blade. A support member for the cleaning member can be directly connected to the side plates.

It is to be understood that both the foregoing general description of the invention and the following detailed description are exemplary, but are not restrictive of the invention.

BRIEF DESCRIPTION OF THE DRAWINGS

The accompanying drawings, which are incorporated in and constitute a part of the specification, illustrate the invention, and, together with the description, serve to explain the principles of the invention.

DESCRIPTION OF THE PREFERRED EMBODIMENTS

Embodiments of the present invention are explained below, referring to the figures.

Figure 1:
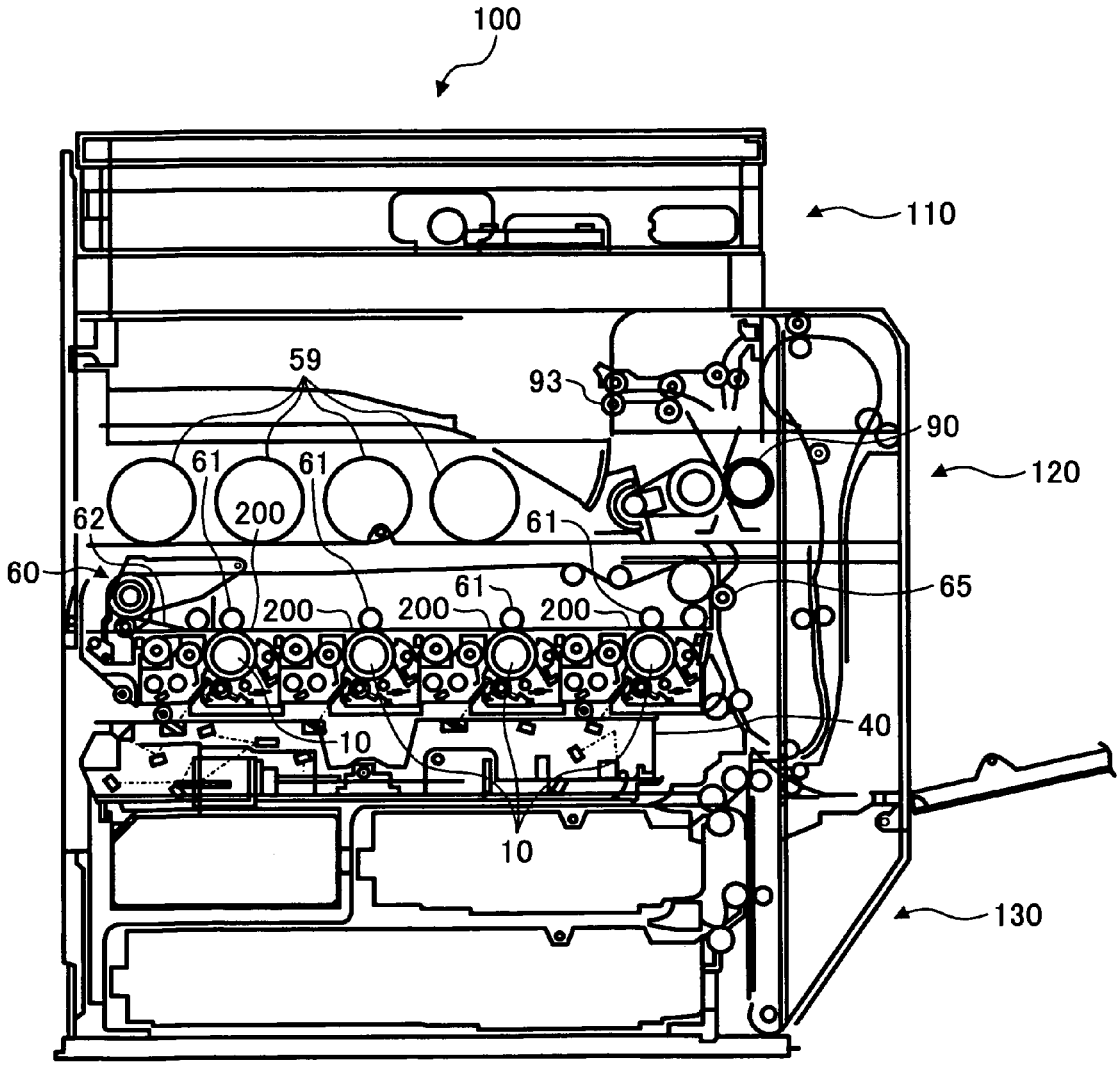
FIG. 1 is a sectional side drawing showing an image forming apparatus in accordance with an embodiment of the invention.

FIG. 1 is a sectional side drawing showing an embodiment of an image forming apparatus for forming a color image. The image forming apparatus 100 includes an apparatus body 120 containing four process cartridges 200 (for colors Y, C, M, K) horizontally mounted in the apparatus, an intermediate transfer belt 62 formed as a loop, preliminary transferring rollers 61 corresponding to each process cartridge 200, a secondary transferring roller 65, and toner bottles 59 for supplying color toner to the process cartridges 200. In the embodiment of FIG. 1, the intermediate transfer belt 62, the preliminary transferring rollers 61 and the secondary transferring roller 65 are used as a transferring device.

The intermediate transfer belt 62 is arranged above a plurality of photoconductive drum 10 in each process cartridge 200 as shown in FIG. 1. A lower edge of the intermediate transfer belt 62 contacts each photoconductive drum so that the preliminary transferring rollers 61 inside of the intermediate transferring belt 62 can transfer an image onto the intermediate transferring belt 62 from the surface of each photoconductive drum 10. In this embodiment, an intermediate transfer belt 62 is used. However, an intermediate transfer belt 62 is merely an example of a transfer element that collectively transfers images from each surface of the photoconductive drum 10. In another embodiment, a direct transferring mechanism to form an image from a photoconductive drum to a recording medium directly can be used. Further, each transferring mechanism for each photoconductive drum is substantially the same except for a forming color.

Figure 2:
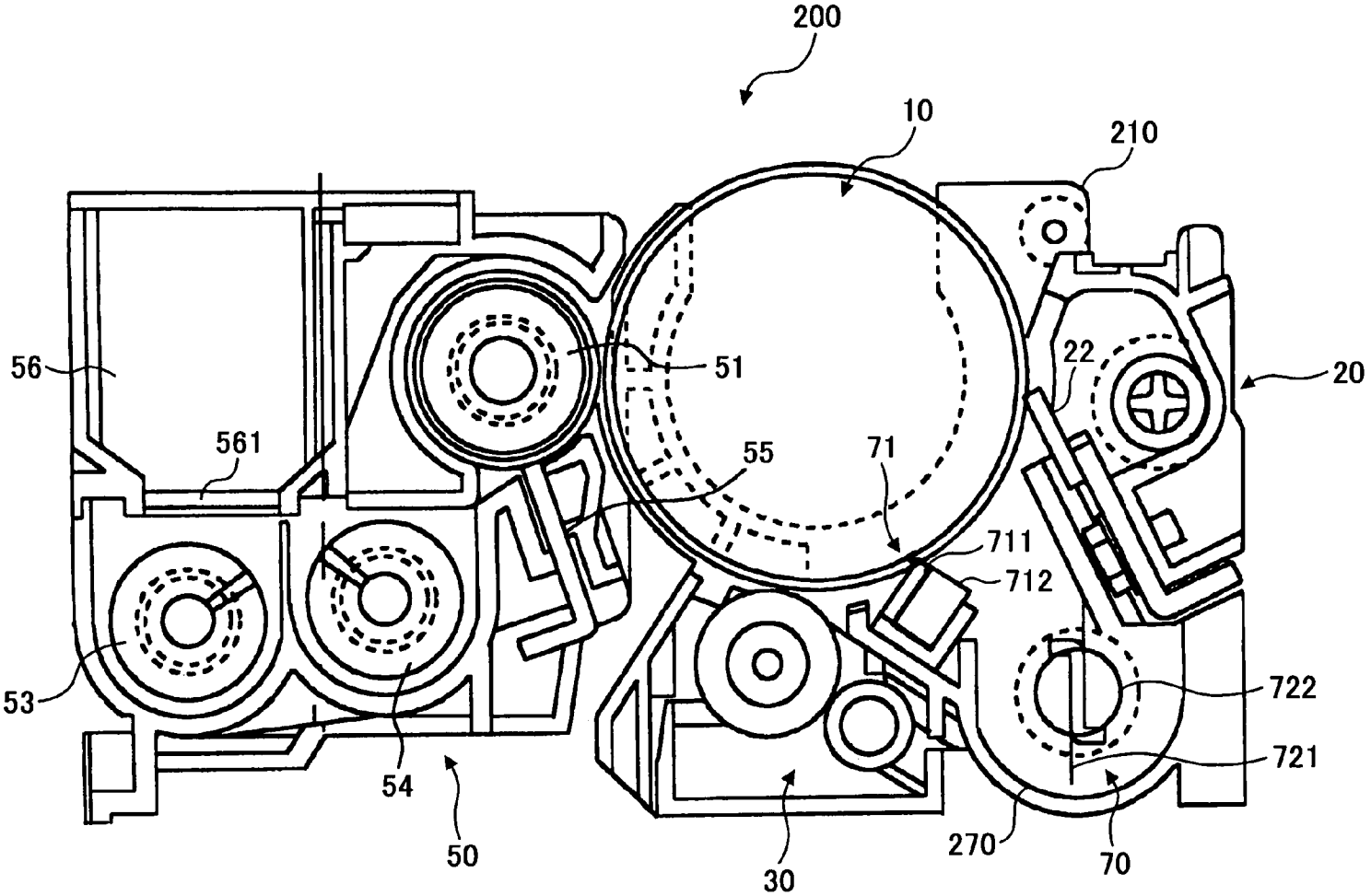
FIG. 2 is a sectional drawing showing a process cartridge in accordance with an embodiment of the invention.

FIG. 2 is a sectional drawing showing a process cartridge 200. Each process cartridge 200 includes a cleaning module 20 as a cleaning device, a charging module 30 as a charging device, a developing module 50 as a developing device. A process cartridge frame 210 is coupled to at least the photoconductive drum 10 and a cleaning blade 22 of the cleaning module 20. The photoconductive drum 10 as a photoconductive member is rotated in a clockwise direction as shown. The charging module 30 uniformly charges a surface of photoconductive drum 10 to a preferable polarity. After charging, an exposing device 40 (shown in FIG. 1) generates a light beam incident on the photoconductive drum 10 so that a latent image is formed on the photoconductive drum 10. The developing module 50 then develops the latent image using a corresponding color toner so that a visible image is formed on the photoconductive drum 10.

Referring again to FIG. 1, a plurality of preliminary transferring rollers 61 mounted opposite to a respective photoconductive drum 10 so that the intermediate transfer belt 62 forms a nip between the photoconductive drum 10 and the preliminary transferring roller 61. Therefore, when the preliminary transferring roller 61 is applied a transferring bias, the image on the photoconductive drum 10 is transferred to the intermediate transferring belt 62. Consequently, an overlapped image is formed on the intermediate transfer belt 62 from the plurality of photoconductive drum 10. After this transfer, a cleaning module 20 (shown in FIG. 2) removes a residual toner from the photoconductive drum 10. Downstream of the cleaning module 20, a coating device 70 (also shown in FIG. 2) is mounted to coat lubricant on the photoconductive drum 10 to prevent abrasion, so that a higher cleaning ability can be obtained.

Further, referring to FIG. 1, a feeding device 130 with a cassette accommodating recording mediums (e.g. a paper, a sheet and so on) is mounted in a bottom portion of the image forming apparatus 100. At a preferred time, the feeding device 130 can feed the recording medium to a nip between the intermediate transferring belt 62 and the secondary transferring roller 65. At that time, the secondary transferring roller 65 is applied a preferred transferring bias from a power source so that the overlapped image on the intermediate transferring belt 62 is finally transferred on to the recording medium.

The recording medium having an overlapped image formed thereon is upwardly fed to a fixing device 90, which fixes the image on the recording medium by use of heat and pressure. After this fixing, the recording medium is discharged to an upper surface of the image forming apparatus 100 by each discharging roller 93. Also, a scanner device 110 may be mounted on an upper side of the image forming apparatus 100 to scan an image data and to send a signal to a processing device not shown.

In the embodiment of FIGS. 1 and 2, each process device (i.e. a cleaning device, a charging device, a developing device and the like) is formed as a module that is coupled to the photoconductive drum, for example, within the process cartridge. Therefore, after a process cartridge is removed from an image forming apparatus, a new process device module can be replaced in the process cartridge, while a still usable part (such as the photoconductive drum) can remain in the process cartridge. Therefore there can be a small number of wasteful parts in the process cartridge. Further, in this embodiment, there is a great improvement because a user or a service person can replace a process device in an image forming cartridge with a new one, or can replace the process cartridge itself with a new one.

Figure 3:
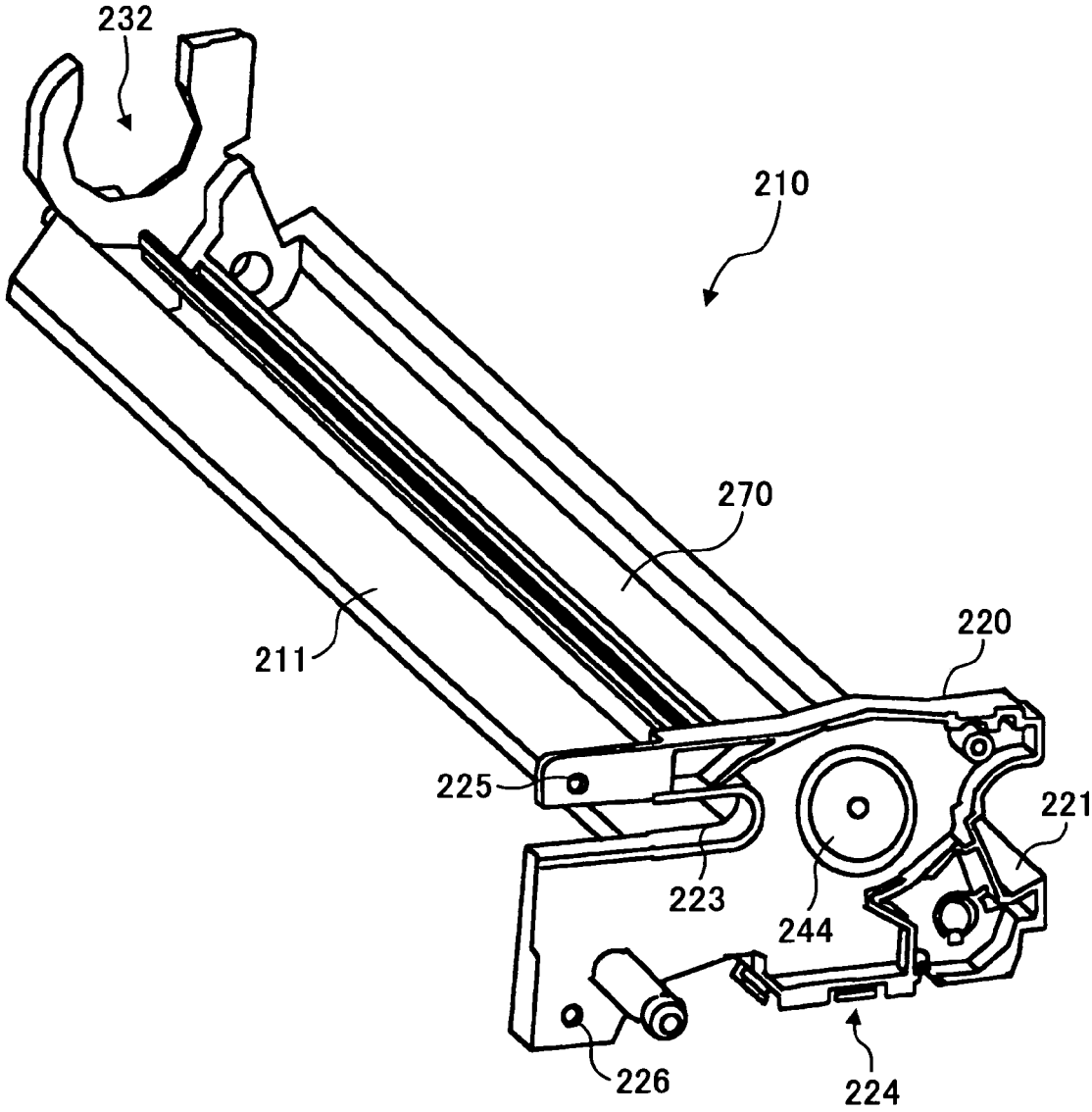
FIG. 3 is a partial perspective drawing showing a process cartridge frame in accordance with an embodiment of the invention.

As noted with respect to FIG. 2, each process cartridge 200 includes a process cartridge frame 210 (hereinafter, may be indicated by a frame), which is coupled to at least a photoconductive drum 10 and a cleaning blade 22. FIG. 3 is a partial perspective drawing showing the process cartridge frame 210. The process cartridge frame 210 has a frame body 211 including a side frame 220 (hereinafter, indicated as a first side frame or side plate 220) shown forward of the drawing, and a lubricant accommodating frame 270 to accommodate a coating device 70 (shown in FIG. 2) and a powder lubricant. The frame body 211 retains a charging module 30 (shown in FIG. 2). The first side frame 220 includes a bearing 244 to retain a rotatable axis 14 projected from a photoconductive drum 10 (shown in FIG. 5), a guiding portion 223 to guide a developing module 50 (shown in FIG. 10), and fixing holes 225 and 226 to retain the developing module 50. As shown in a rear portion of the drawing, the process cartridge frame includes a temporary placing portion 232 to temporarily place a photoconductive drum 10. Also, the first side frame 220 has a first contacting surface 221 as a first contacting portion, to retain a supporting plate 21 (shown in FIG. 7B) of a cleaning module 20.

Figure 4:
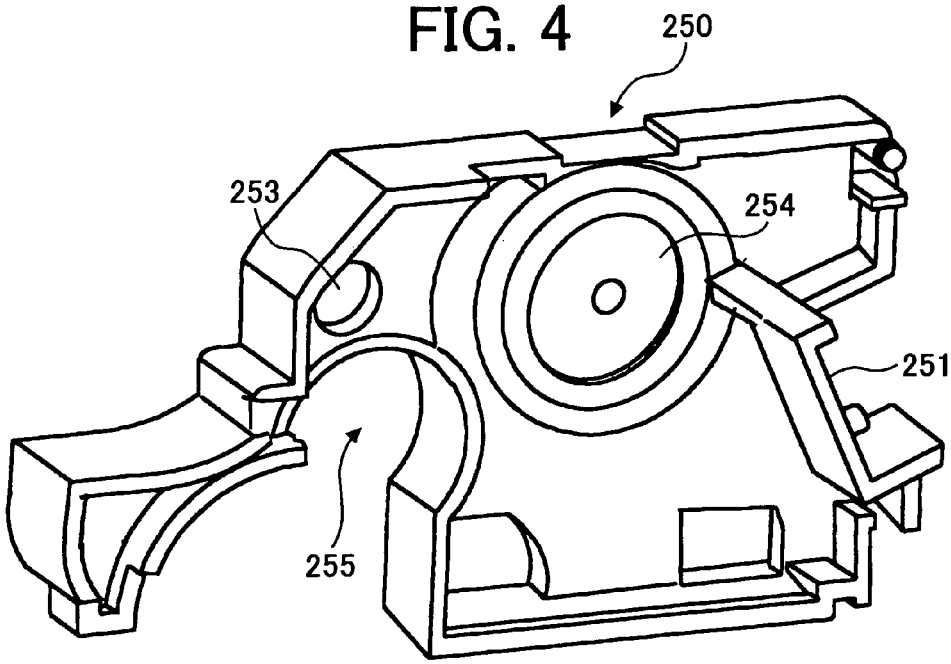
FIG. 4 is a perspective drawing of a side plate in accordance with an embodiment of the invention.

FIG. 4 is a perspective drawing of a side plate 250 (hereinafter, indicated by a second side plate 250). The second side plate 250 may be mounted to a rear position side of a process cartridge frame 210 adjacent to the temporary placing portion 232. The second side plate 250 includes a second contacting surface 251 as a second contacting portion, to retain a supporting plate 21 of a cleaning module 20, a bearing 254 to retain an axis 14 of a photoconductive drum 10, a shaft supporting portion 253 to retain a shaft 511 of a developing sleeve 51 (shown in FIG. 10), and a guiding portion 255 to guide a conveying roller 54. In such embodiment, a first supporting surface 221 of a first side plate 220 and a second supporting surface 251 of a second side plate 250 can maintain a preferable contact position between a supporting plate 21 of a cleaning module 20 and a photoconductive drum 10. In one embodiment, maintaining a preferable contact position can be facilitated by alignment projections on the supporting surface 251 as shown in FIG. 4. Mounting screws may also be used.

Figure 5:
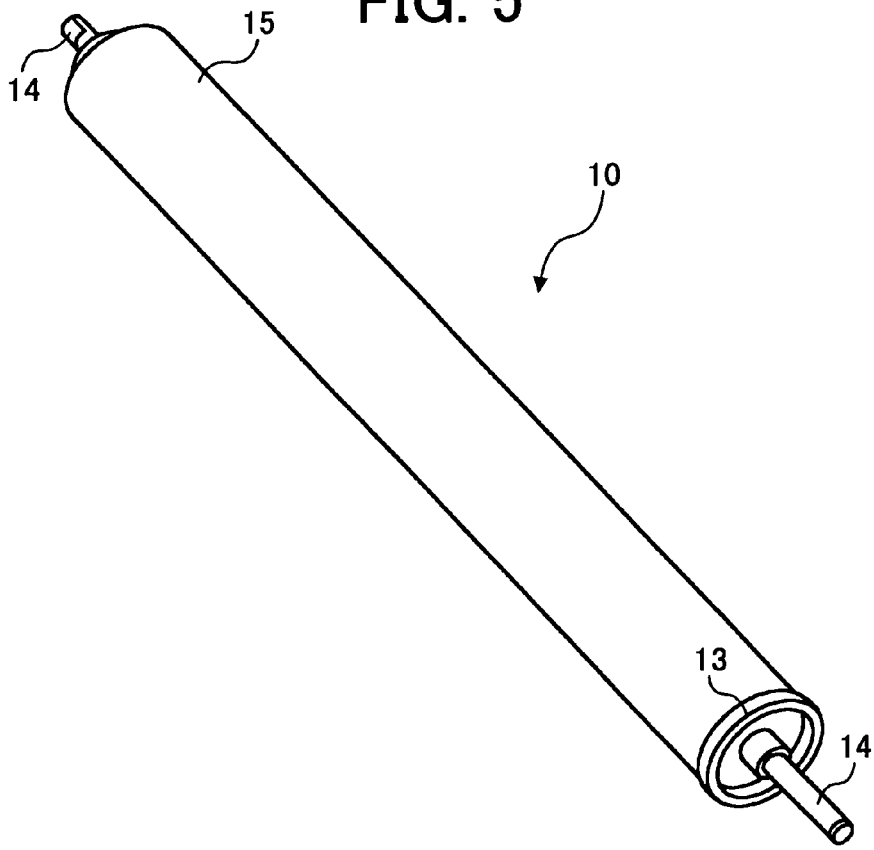
FIG. 5 is a perspective drawing of photoconductive drum in accordance with an embodiment of the invention.

FIG. 5 is a perspective drawing of photoconductive drum 10 that can be mounted in a process cartridge 200. As shown, a photoconductive drum 10 forms a cylinder image carrier. Flanges 13 and 15 are mounted at opposing sides of the photoconductive drum 10. Further, a rotatable axis 14 penetrates both of the flanges 13 and 15.

Figure 6:
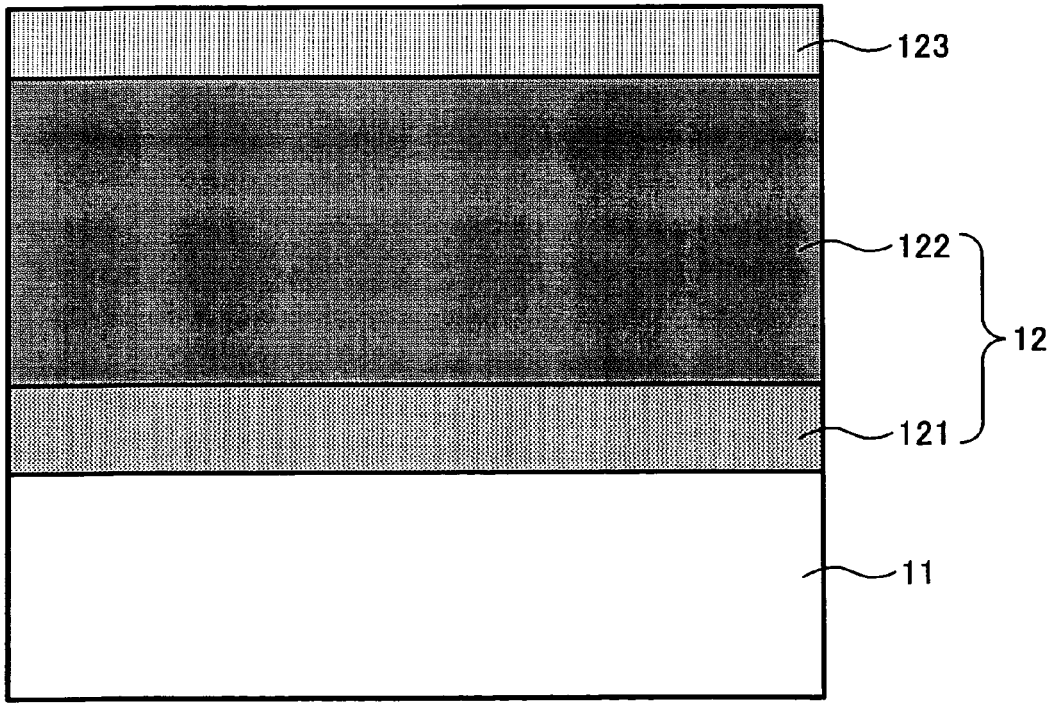
FIG. 6 is a diagram showing a general structure of photoconductive layers of a photoconductive drum in accordance with an embodiment of the invention.

FIG. 6 is a diagram showing a general structure of layers of the photoconductive drum 10. A substrate 11 of the photoconductive drum 10 shown in FIG. 6 is made of a metal such as aluminum, copper or steel, or an alloy of such metals. The substrate 11 is formed into a generally cylindrical pipe shape by subjecting the metal or metal alloy to a process such as extruding or drawing, and then surface processing (such as cutting, superfinishing or polishing) so as to form a cylindrical drum. A photoconductive layer 12 is formed by a charge generating layer 121 having a charge generating material as a main component, and a charge transfer layer 122 which transfers a generated charge to the surface of the photoconductive drum 10 or the substrate 11. The charge generating layer 121 may be formed by scattering the charge generating material within a suitable solvent, together with a binding resin if necessary, by use of a ball mill, an attriter, sand mill, ultrasonic wave or the like. The charge generating material is then coated on the conductive support to be dried thereon. A known charge generating material may be used for the charge generating layer 121. Typical charge generating materials usable as the charge generating layer 122 include mono azo pigment, di azo pigment, tris azo pigment, perylene-based pigment, perynone-based pigment, quinacridone-based pigment, quinone-based condensed polycyclic compound, squalic acid-based dye, phthalocyanine-based pigment, naphthalocyanine-based pigment and azulnenium salt based dye. The azo pigment and/or the phthalocyanine-based pigment is particularly suited for use as the charge generating material.

The charge transfer layer 122 may be formed by dissolving or scattering a charge generation (or transport) material and a binding resin into a suitable solvent, and coating the charge generation material on the charge generating layer 121 to be dried thereon. A plasticizer, a leveling agent, an antioxidant or the like may be added to the charge generation material if necessary. The charge generation material may be categorized into a hole generation (or transport) material, or an electron generation (or transport) material. For example, the electron generation material includes chloranyl, bromanyl and tetracyanoethylene, and the hole generation material includes poly-N-vinylcarbazole and its derivative, poly-γ-carbazoleethylglutamate and its derivative, pyrene-formaldehyde condensed material and its derivative, polyvinylpyrene and polyvinylphenanthrene.

In order to protect the photoconductive layer 12, a protection layer 123 may be provided on the photoconductive layer 12. A filler may be added to the protection layer 123 for the purposes of improving the wear (or abrasion) resistance. From the point of view of the hardness of the filler, it is advantageous to use an inorganic filler material. Silica, titanium oxide and alumina are particularly effective when used as the inorganic filler material.

Figure 7A:
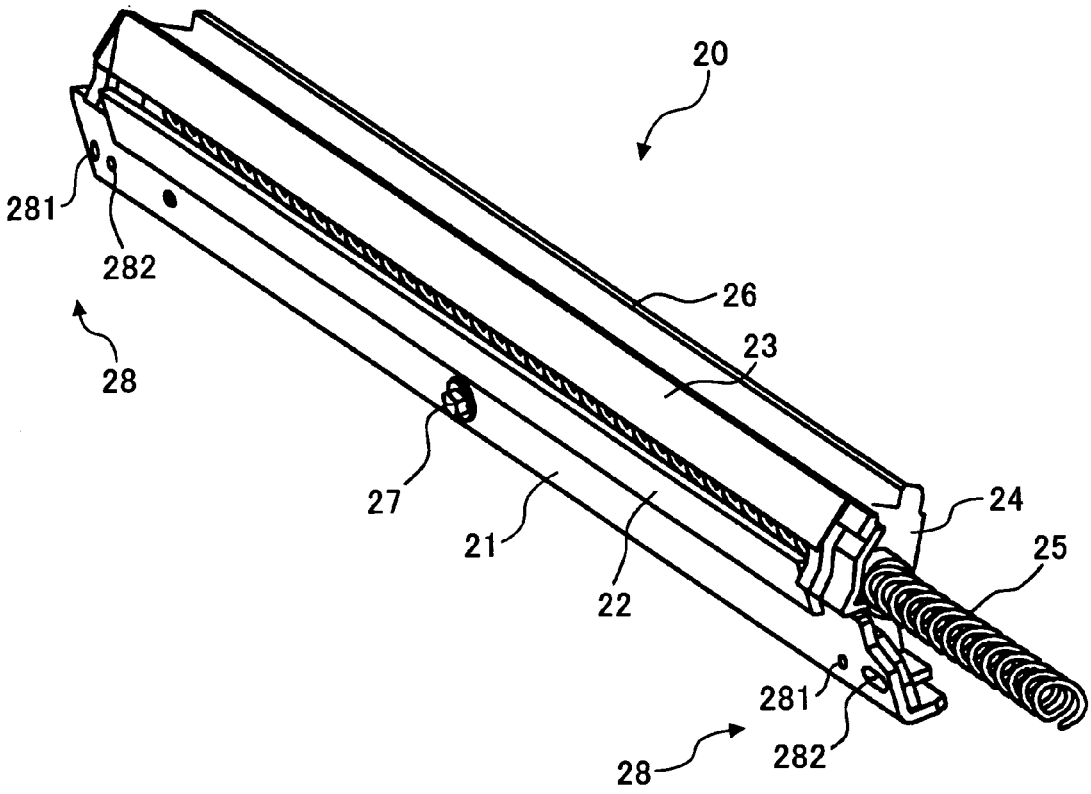
FIG. 7(A) is a perspective drawing of a cleaning module of a process cartridge.
Figure 7B:
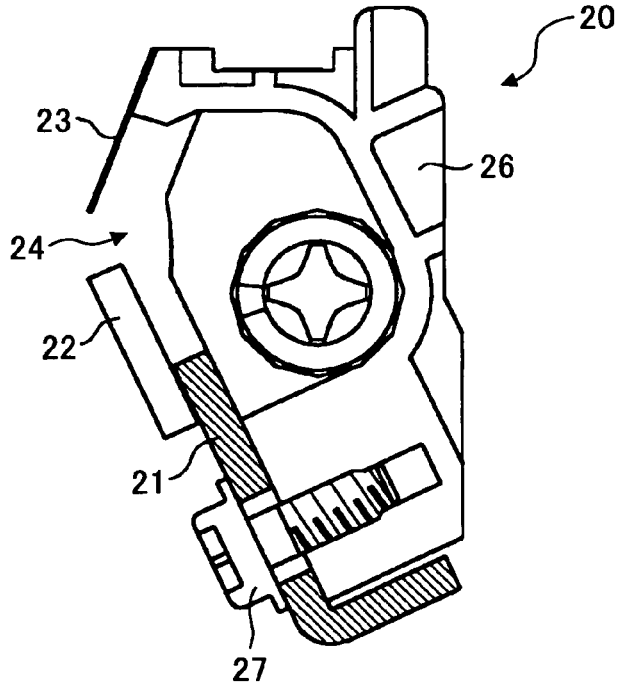
FIG. 7(B) is a cross sectional drawing of the cleaning module in accordance with an embodiment of the invention.

FIG. 7(A) is a perspective drawing of a cleaning module 20 of a process cartridge 200 in accordance with an embodiment of the invention. FIG. 7(B) is a cross sectional drawing of the cleaning module of FIG. 7A. As shown, a cleaning module 20 includes a cleaning blade 22 as a cleaning member, a supporting plate 21 as a supporting member to directly support the cleaning blade 22, an opening seal 23 to seal a housing 26 to which accommodates the residual toner in a residual toner accommodating portion 24, and a conveying screw 25 to convey the residual toner to inside of a image forming apparatus 100. The support member 21 is shown in FIGS. 7A and 7B as an L shaped piece wherein a straight segment, to which the cleaning member is directly connected, is an integral piece. However, such straight segment may be made of multiple layers welded, adhered or fastened together to effectively form an integral unit. In such case, the cleaning member is considered to be directly connected to all layers of the segment. The supporting plate 21 preferably mounts to the housing 26 by a screw 27 on about a middle portion of a length direction of a straight segment of the supporting plate 21 as shown in FIG. 7B. In this embodiment, a cleaning member is formed as a cleaning blade to remove residual toner on photoconductive drum 10. However, in another embodiment, a cleaning roller, a cleaning brush, a coating lubricant member, a bias charging roller and various member contacting on a photoconductive member can be utilized.

At both ends of the supporting plate 21, there are hole portions 281 and 282 as fixing portions 28, for an accurate fixing. The hole portions 281 are formed corresponding to projections mounted on the first and second surface 221 and 251 of the process cartridge frame and second side plate respectively. Moreover, the hole portions 282 can be penetrated by a fixing screw. However, an accurate fixing is not restricted to such structure, another embodiment can be adopted, e.g. inserting an elastic body to a hole or a hollow, without any screw. Further, without a screw, an E-formed ring can fix a projection.

Figure 8A:
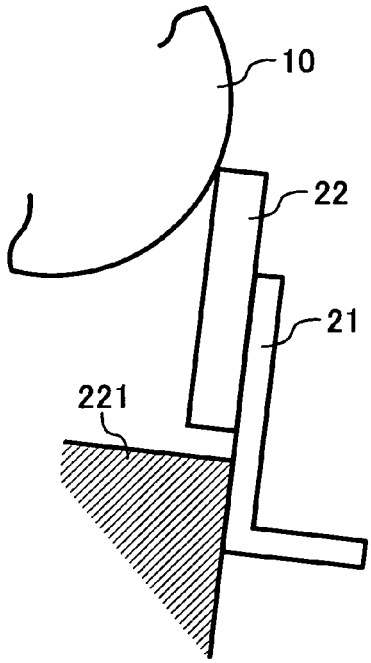
FIG. 8(A) and FIG. 8(B) are explanatory diagrams showing a mounting position of a cleaning blade in accordance with an embodiment of the invention.
Figure 8B:
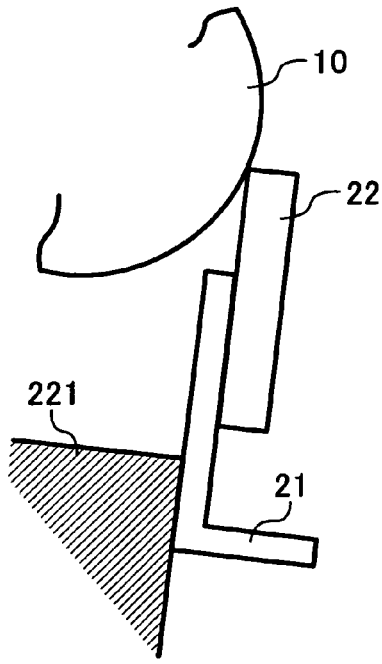

FIG. 8(A) and FIG. 8(B) are explanatory diagrams showing a mounting position of a cleaning blade. In the embodiment, as shown FIG. 8(A), a cleaning blade 22 is mounted on a supporting plate 21 so that the first and second contacting surfaces 221 and 251 (251 is shown in FIG. 4, but not shown in FIG. 8) are on a same side with the cleaning blade 22. However, in another embodiment, a cleaning blade 22 can be mounted on a supporting plate 21 so that the first and second contacting surfaces 221 and 251 are on an opposite side to the cleaning blade 22, as shown FIG. 8(B). Both embodiments are acceptable to the present invention. However, if a mounting position as shown FIG. 8(A) is used, it can be disregarded that an error range of a thickness of the supporting plate 21 has an impact on a contacting condition between a cleaning blade 22 and a photoconductive drum 10, so that the cleaning blade 22 can accurately contact the photoconductive drum 10.

In the above described embodiment, contacting portions 221 and 251 form a surface to retain both ends of a supporting plate 21, which retains a cleaning blade 22 as a cleaning member to contact on a photoconductive drum 10. However, the present invention is not restricted in such an embodiment; for example, it is acceptable if a contacting portion 221 and 251 determine a position of a cleaning blade 22 to contact on a photoconductive drum 10.

A material of a cleaning blade 22 is preferable elastomer having fluorine, silicone, urethane and the like. Especially, urethane elastomer is preferable because of a less ablution, a less ozone and a less pollution. In one embodiment, a section of supporting plate 21 forms an L character form so that a cleaning blade accurately contacts on a photoconductive drum 10 without any bending. Also, a material of the supporting plate 21 may be made of a SUS (stainless steel) metal in a thickness of 2.0 mm for strength. However, it is preferable to use iron, aluminum, phosphorus bronze, and the like. In this embodiment, a bonding agent activated with heat or pressure bonds a cleaning blade 22 on a supporting plate 21. However, a double-sided tape, a bonding agent or the like is also acceptable.

Figure 9:
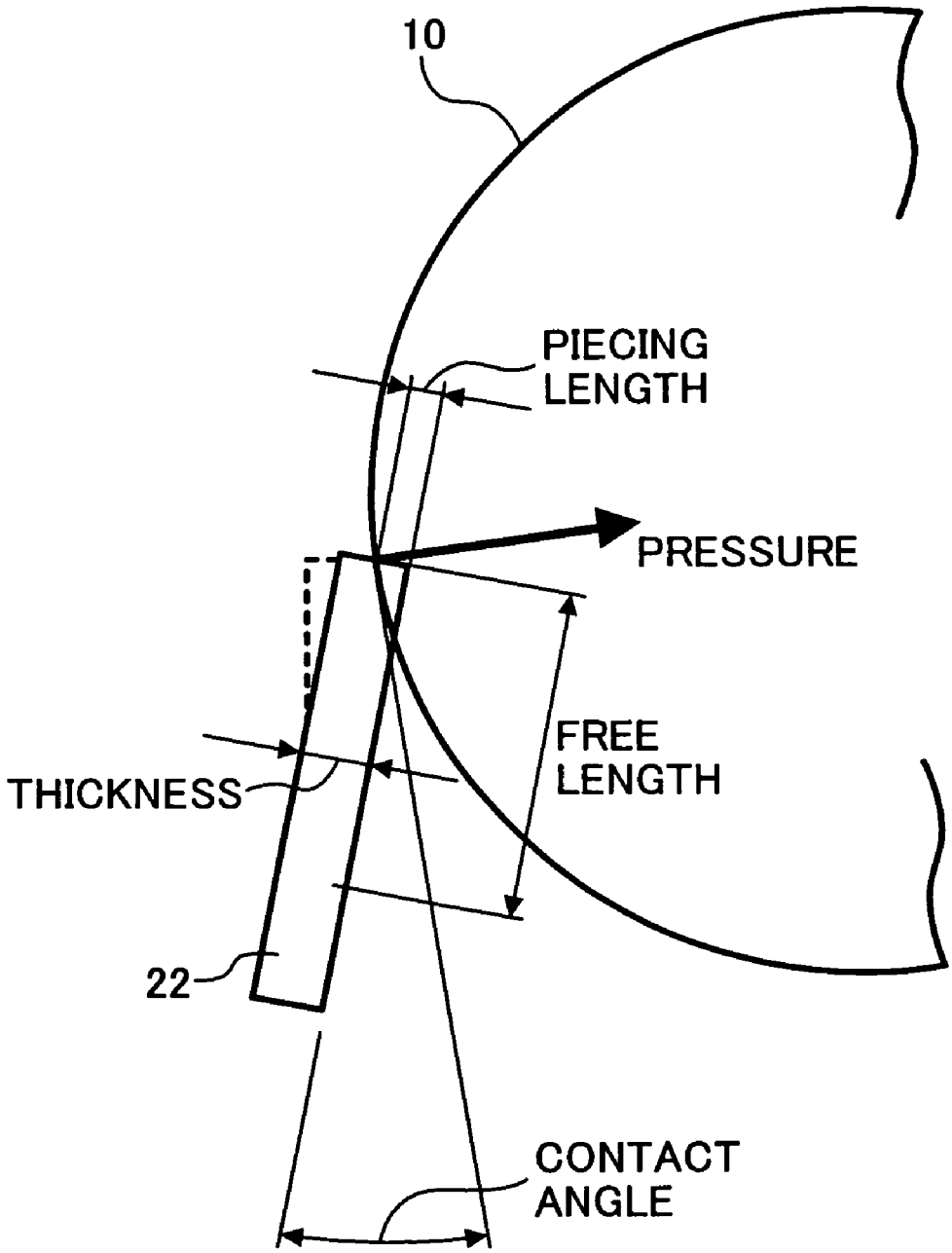
FIG. 9 is an explanatory diagram showing a contacting condition of a cleaning blade in accordance with an embodiment of the invention.

FIG. 9 is an explanatory diagram drawing showing a contacting condition of a cleaning blade 22. In the embodiment, the cleaning blade 22 counter-contacts to a rotation direction of a photoconductive drum 10. However, cleaning blade 22 can contact in the same direction with a rotation of a photoconductive drum 10. Especially, as this embodiment, a cleaning blade preferably contacts by counter-contacting to obtain a higher cleaning ability.

Cleaning blade 22 preferably has a hardness (JIS-A) from 60 degrees to 85 degrees. In the case that hardness is less than 60 degrees, it might be hard to remove a residual toner because a form of the cleaning blade is easily changed. In the case that hardness is more than 85 degrees, higher abrasion of the photoconductive drum 10 may be caused so that a lifetime of an image forming apparatus would be short. It would be preferable that a pressure of a cleaning blade 22 as a contacting condition is from 10 to 60 gf/cm. In the case that a pressure is less than 10 gf/cm, it might be hard to remove a residual toner having a volume mean size of less than 2 micrometer. In the case that a pressure is more than 60 gf/cm, an edge portion of a cleaning blade might be reversed or vibrated so that a cleaning ability is reduced.

It would also be preferable that an elasticity of a cleaning blade 22 is from 4.5 to 10 MPa, a free length of a cleaning blade 22 is from 5 to 12 mm, a thickness of a cleaning blade 22 is from 1 to 2 mm, and a contact angle of a cleaning blade 22 to a tangential line projecting from a contact portion is from 5 to 25 degrees. In the case that a contact angle is less than 5 degrees, a toner might be passed through at a nip formed by a cleaning blade 22, so that a cleaning ability might be reduced. Contrary, in the case that a contact angle is more than 25 degrees, an edge portion of a cleaning blade 22 might be reversed. A piecing length of a cleaning blade 22 to a photoconductive drum 10 is preferably from 0.1 to 2.0 mm. In the case that a piecing length is less than 0.1, a cleaning blade 22 contacts a photoconductive drum 10 at a small area so that a toner might be passed through at a nip formed by a cleaning blade 22, so that a cleaning ability might be reduced. In the case that a piecing length is more than 2.0 mm, a friction force between a cleaning blade 22 and a photoconductive drum 10 is higher so that an edge portion of a cleaning blade 22 might be reversed or vibrated, consequently a cleaning ability is less.

Figure 10:
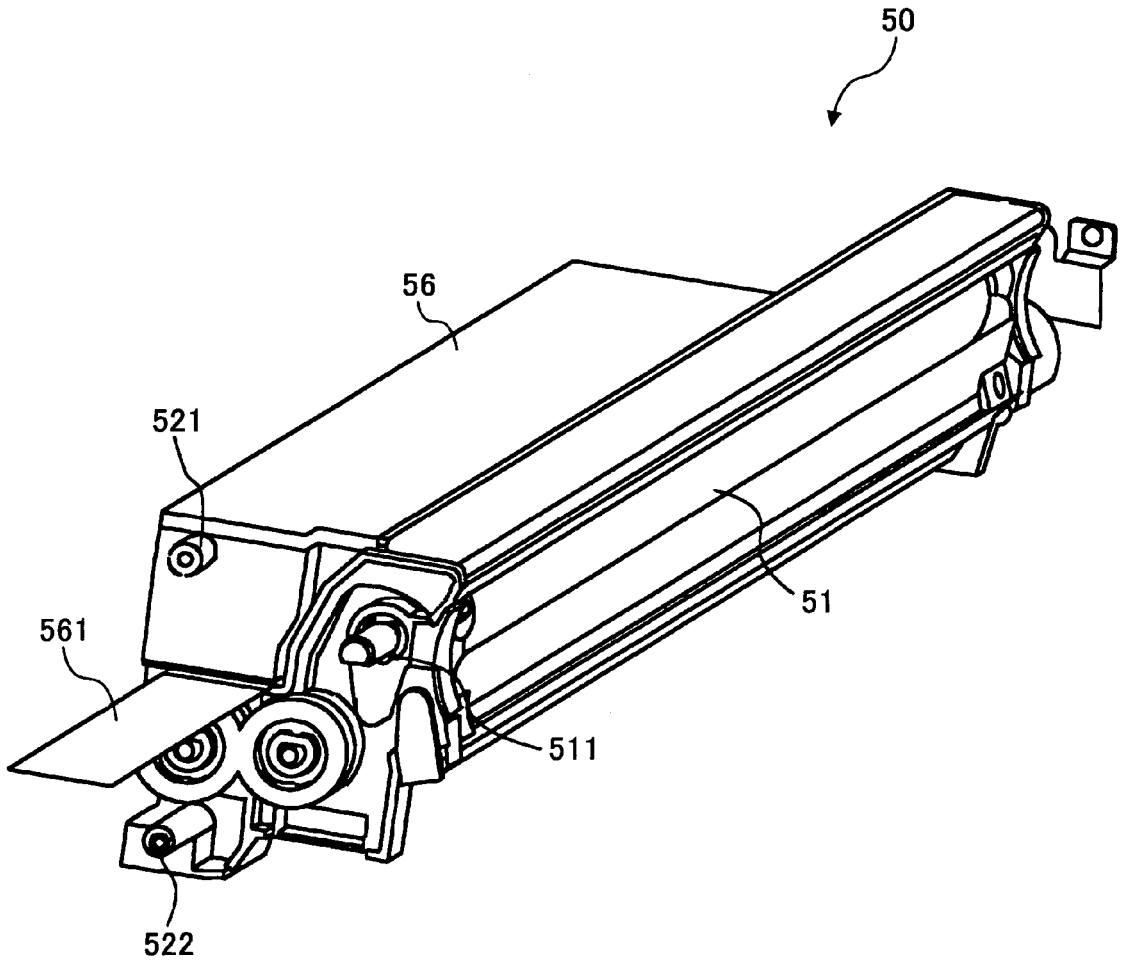
FIG. 10 is a perspective drawing of a developing module in accordance with an embodiment of the invention.

FIG. 10 is a perspective drawing of a developing module 50, which corresponds to the developing module shown as a cross sectional drawing FIG. 2. Referring again to FIG. 2, a developing module 50 includes a developing sleeve 51 as a developer bearing element configured to be mounted near a photoconductive drum 10, a supply opening to be supplied in the developing module 50 from toner bottles mounted outside a process cartridge 200 or other supplying device, agitating and conveying screws 53 and 54 to respectively agitate and convey a supplied toner with a magnetic carrier, and a restricting member 55 to control a developer conveyed on the developing sleeve 51.

As shown in FIG. 10, a developing module 50 further includes a driving axis 511 to rotate the developing sleeve 51, and positioning projections 521 and 522 formed on a surface of the developing module 50 to be guided when the developing module 50 is loaded on a process cartridge 200. Also included is a partition sheet 561 to prevent a developer from going outside the developing module, and a developer accommodating portion 56 to accommodate a developer. As this embodiment, a partition sheet 561 can seal a developer accommodating portion 56 so that a developer does not leak outside of the module during shipment. When partition sheet 561 is removed on a first use of a developing module 50, a developer can be conveyed to an agitating and conveying screw 53 from the developer accommodating portion 56.

The developing sleeve 51 can be made of a nonmagnetic material such as aluminum, brass, stainless, conductive resin and the like, and is formed as a cylinder. Further, the developing sleeve 51 is rotatably driven by a driving mechanism so that it can convey a developer by magnetic force of a magnetic member arranged inside of the developing sleeve 51. A restricting member 55 (shown in FIG. 2) is mounted upstream at a developing area in a direction of conveying a developer and restricts a height of a developer chain, i.e. an amount of developer, supplied to the developing sleeve 51.

A developer type is selectable from a two-components developer including a toner and a magnetic carrier, a magnetic one-component developer, or a nonmagnetic one-component developer. According to the type of developer used, the specification of a developing sleeve may have to be changed to a proper one.

Figure 11:
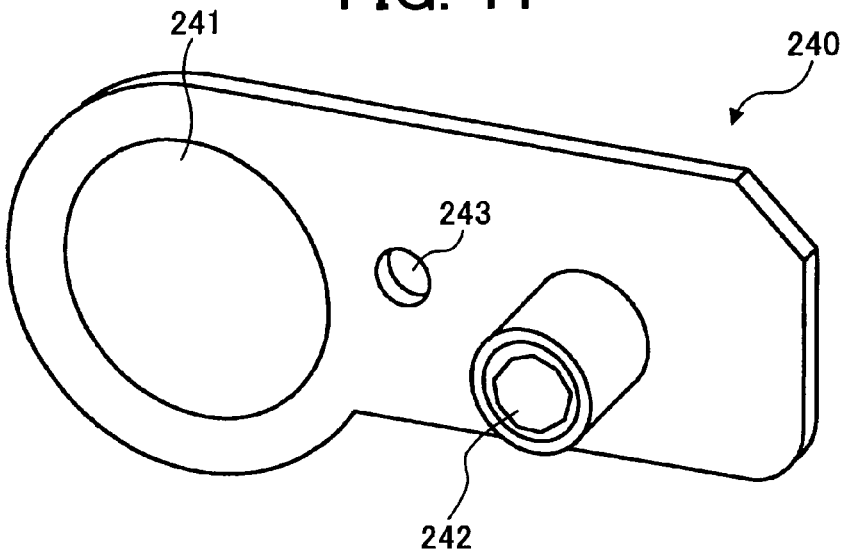
FIG. 11 is a perspective drawing showing a fixing member to position a developing module on a process cartridge in accordance with an embodiment of the invention.

FIG. 11 is a perspective drawing showing a fixing member to position developing module 50 on a process cartridge 200. Fixing member 240 includes a hole portion 241 to be positioned to a photoconductive drum 10 by fitting bearing 244 of the side frame of the drum 10. An insertion portion 242 of the fixing member is inserted to a shaft 511 of a developing sleeve 51 of a developing module 50, and a fixing hole portion 243 is used to insert a screw fixing and fixing member 240 on a side frame 220 of the process cartridge frame 210.

Figure 12:
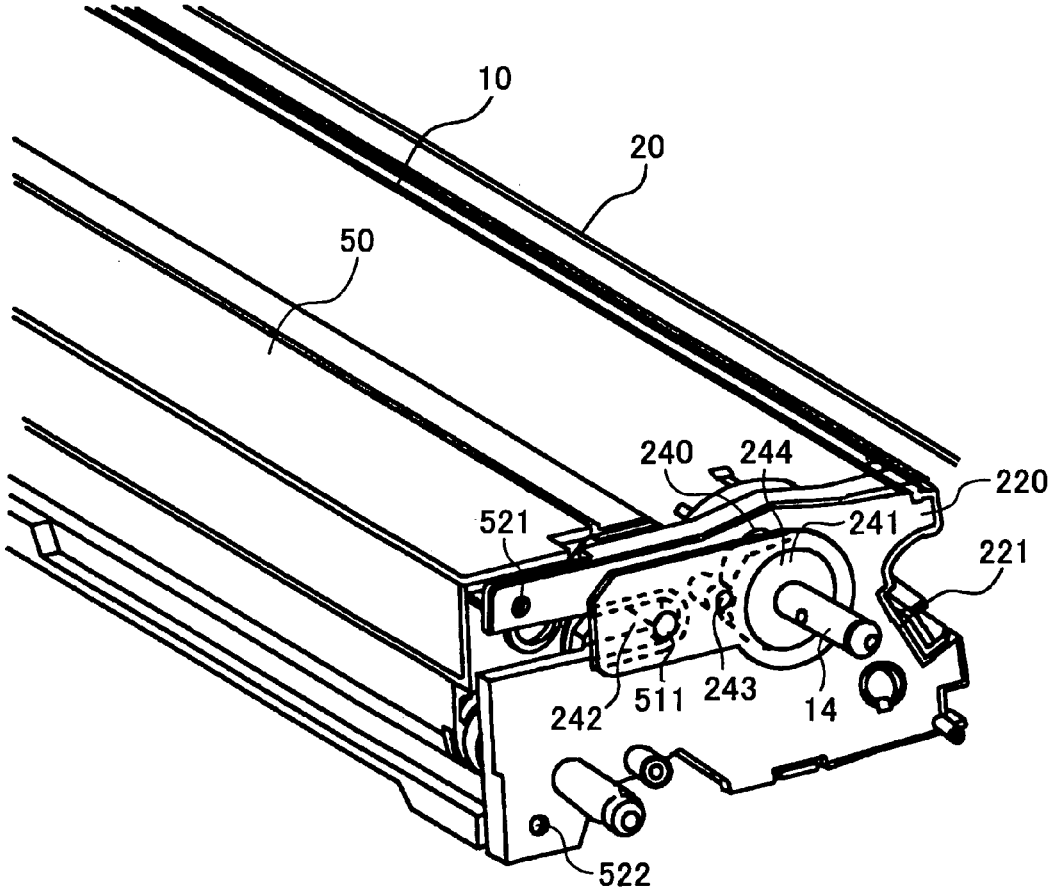
FIG. 12 is a partial perspective drawing showing a side of a process cartridge in accordance with an embodiment of the invention.

FIG. 12 is a partial perspective drawing showing a side of a process cartridge 200, when a fixing member 240 positions a developing module 50 on a process cartridge 200. A rotatable axis 14 of a photoconductive drum 10 is positioned by the rotatable axis 14 being inserted into a bearing 244 mounted on side frame 220 of process cartridge frame 210 as shown FIG. 12. A hole portion 241 of fixing member 240 fits on an outside of bearing 244 and an insertion portion 242 of the fixing member 240 inserts on a shaft 511 of a developing sleeve 51 of a developing module 50, so that the rotatable axis 14 of the photoconductive drum 10 is positioned to the developing sleeve 51. After being positioned as explained above, the developing module 50 is mounted on the process cartridge frame 210 by fixing positioning projections 521 and 522 to fixing holes 225 and 226.

Figure 13:
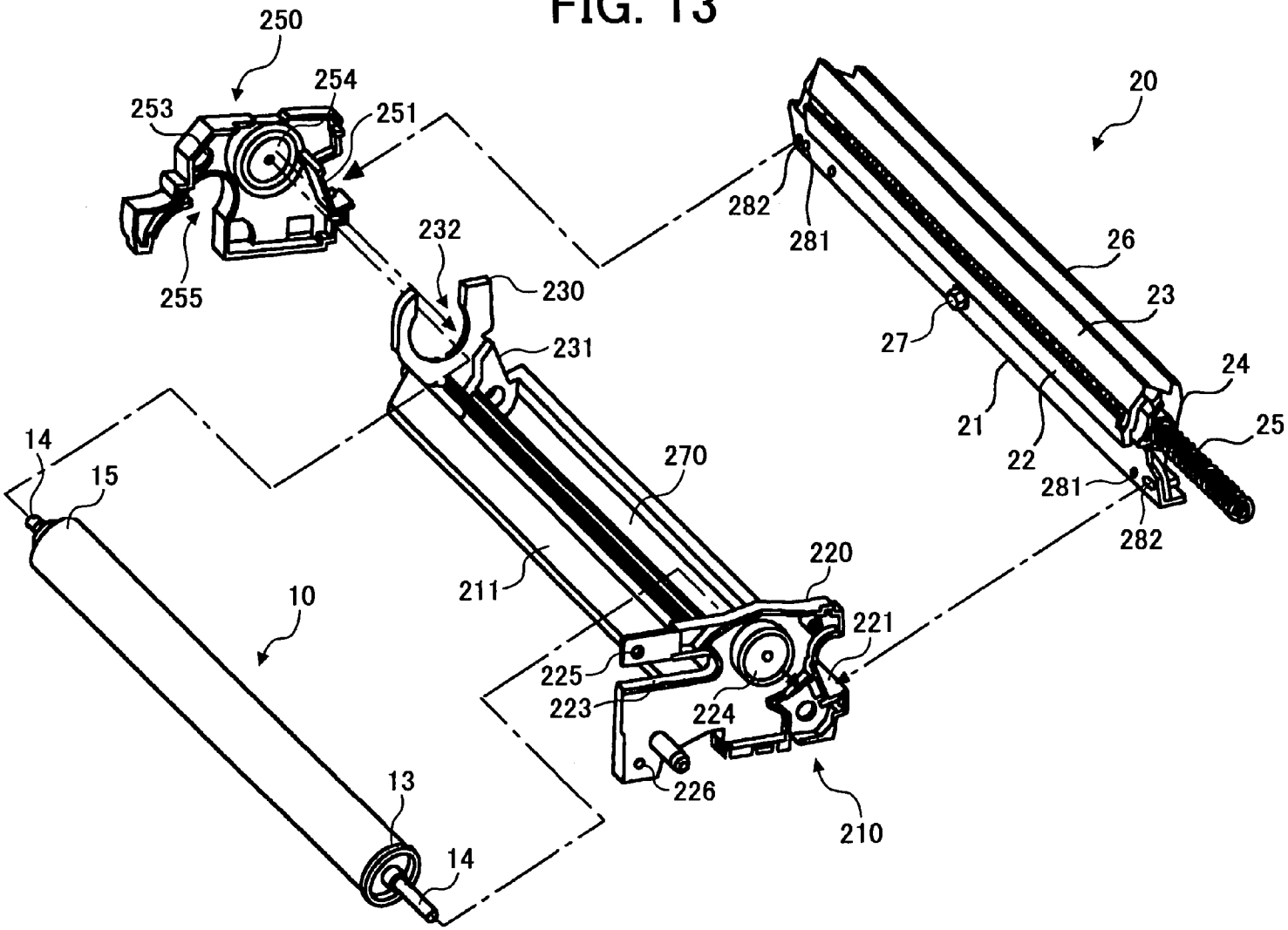
FIG. 13 is an example showing how to assemble a process cartridge in accordance with an embodiment of the invention.

FIG. 13 is an example showing how to assemble a process cartridge 200 in accordance with an embodiment of the invention. A process cartridge 200 of the embodiment is preferably assembled to include both a photoconductive drum 10 and a cleaning blade 22 at the same time by using a process cartridge frame 210 and a side frame 250. Further, a housing 26 having a cleaning blade 22 is also preferably assembled at the same time.

As shown in FIG. 13, at first, a bearing 244 mounted in a side frame 220 of a process cartridge frame 210 is inserted on shaft 14 of a photoconductive drum. Then, an opposite end of the shaft 14 of a photoconductive drum is inserted to bearing 254 mounted in side frame 250. Further, fixing portions 281 and 282 formed at both ends of a supporting plate 21 supporting a cleaning blade 22 are positioned to a first surface 221 of a side frame 220 of a process cartridge frame 210, and to a second surface 251 of a side frame 250 respectively. Since a process cartridge is assembled by such order, the process cartridge is less prone to bending or twisting and the process cartridge can have higher position accuracy. Also, fewer parts for the assemblage is needed.

Figure 14:
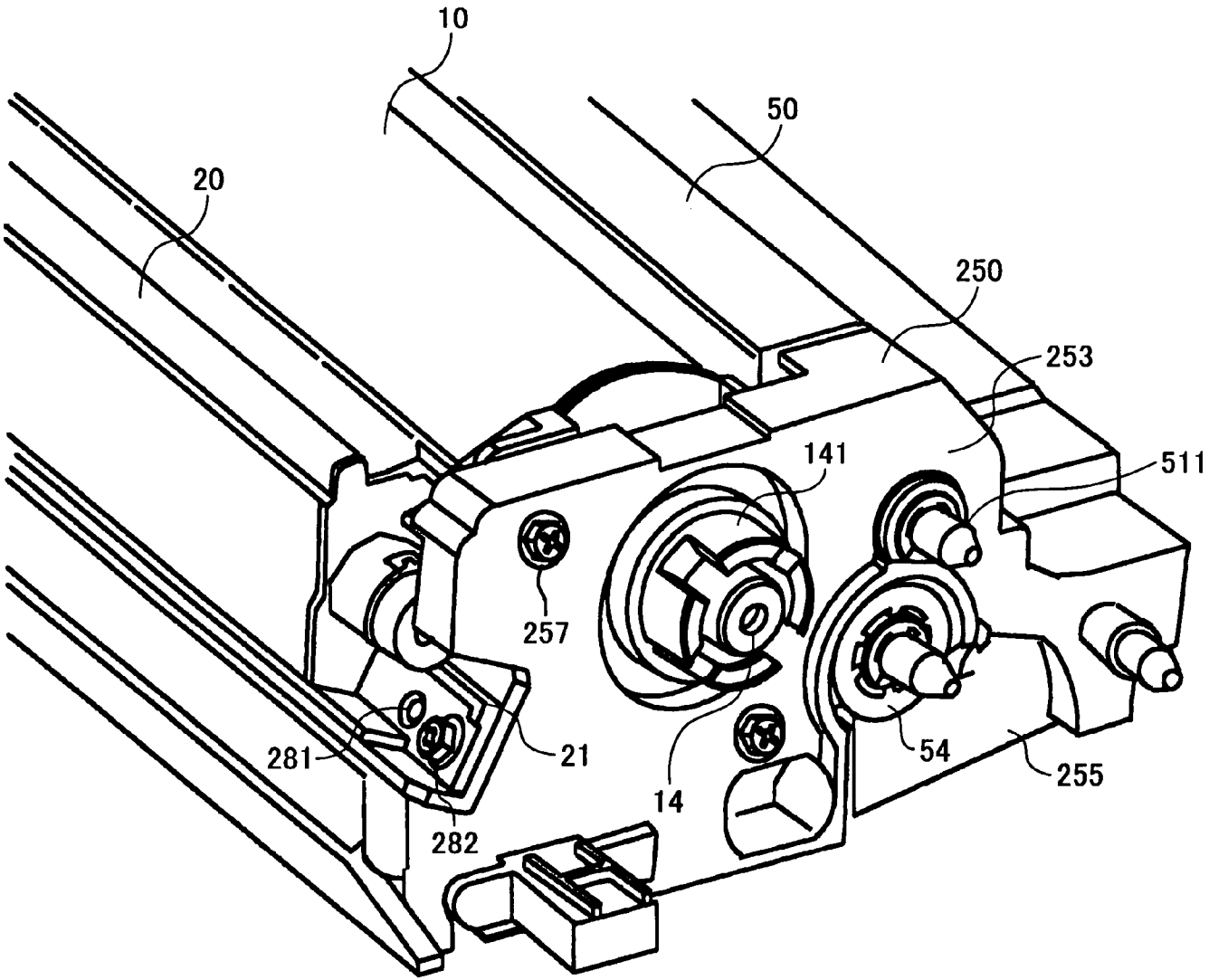
FIG. 14 is a partial perspective drawing showing a side of a process cartridge in accordance with an embodiment of the invention.

FIG. 14 is a partial perspective drawing showing a side of a process cartridge 200, when a photoconductive drum 10 is mounted thereon. A rotatable axis 14 of photoconductive drum 10 is inserted to a bearing 254 of a side frame (or side plate) 250, and then a coupling 141 is attached to an end of the rotatable axis 14. The coupling 141 can be driven by a driving mechanism of an image forming apparatus after a process cartridge is mounted in the image forming apparatus, so that the photoconductive drum 10 is rotatably driven. Cleaning module 20 is positioned by a supporting plate 21 contacting second surface 251 of the side plate 50, and then is guided by a hole portion 281. The cleaning module is then fixed by a fixing screw at a hole portion 282. Further, a developing module 50 is fixed on side frame 250 by a shaft 511 of the developing sleeve 51 being inserted from a shaft supporting portion 253.

As explained in the above embodiment, both of a first surface 221 and a second surface 251 have a projection for accurate fixing, and a hole for an insertion of a screw to fix a supporting plate 21 of cleaning module 20. Therefore, the supporting plate 21 is fixed at both ends of a process cartridge and a length between these fixing portions is as long as possible. This configuration allows the supporting plate 21 to be stably fixed so that a cleaning blade 22 accurately contacts photoconductive drum 10. Each bearing 244 and 254 (to retain both ends of the rotatable axis 14 of a photoconductive drum 10) is positioned in a plane that intersects first and second surface 221 and 251 respectively. Also, each bearing 244 and 254 is near the first and second surface 221 and 251 preferably in close proximity. For example, the bearing 244 and surface 221 (or a bearing 244 and surface 251) are preferably spaced by less than 30 mm, in particular under 20 mm is preferable. In such embodiments, even if a process cartridge shrinks or is transformed by changes of temperature, atmosphere, and use after manufacture, it will be hard to cause a contacting condition between a cleaning blade 22 and a photoconductive drum 10. Therefore, a cleaning ability will be higher. Further, the structure consists of a hole of bearing 244 and surface 221 (or a hole of bearing 244 and surface 251), so that a cleaning ability will be higher.) This close proximity allows ends of the supporting plate 21 to be mounted in close proximity to the bearings 244 and 254. Therefore, supporting plate 21 and a rotatable axis of photoconductive drum 10 can be accurately positioned in distance and angle so that cleaning blade 22 can accurately contact to a photoconductive drum. Also, in the case that a supporting plate 21 is made of a higher strength material (in one embodiment, a SUS metal having a thickness of 2.0 mm), the process cartridge can have higher position accuracy as stated above.

Supporting plate 21 is preferably made of metal having relatively high strength. In such embodiment, the supporting plate 21 can correct bending and/or twisting generated by an assembly of a side frame 220, 250, and a process cartridge frame 210, which may have measure error. Further, it is preferable that a side plate 220 and 250 to retain a supporting plate 21 are manufactured as separate parts. In such embodiment, an impact of bending or twisting of a process cartridge is reduced. Further, since a supporting plate 21 has a higher strength than a frame of the process cartridge, the supporting plate 21 can fix both side plates 220 and 250 as a reference of the process cartridge so that the process cartridge is accurately assembled.

Further, after a supporting plate 21 having higher strength in a cleaning module 20 is mounted on a process cartridge 200, a developing module 50 and a charging module 30 can be accurately mounted because the supporting plate 21 can reduce bending and twisting. However, even if a cleaning module 20 is first mounted on process cartridge frame 210 so that a cleaning blade 22 accurately contacts to a photoconductive drum 10 as explained above, the supporting plate 21 can be affected by force generated by the photoconductive drum 10 when rotated. Therefore, to reduce or prevent rotation of the cleaning module 20, a fixing member 257 preferably fixes the cleaning module 20 on the process cartridge 200 or the fixing member 240 and a side plate 250. The fixing member 257 can be a screw, a pin and the like.

Figure 15:
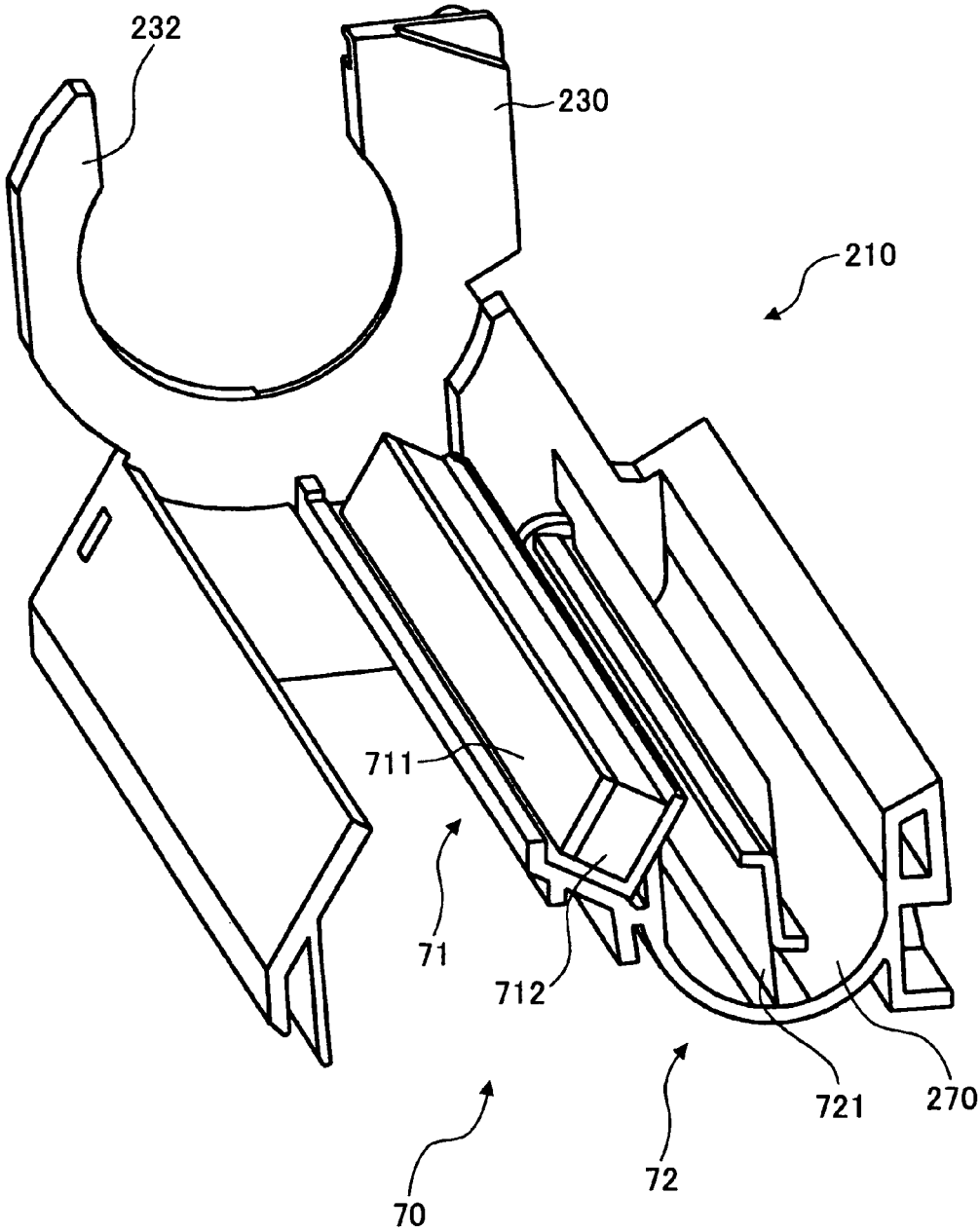
FIG. 15 is a partial perspective drawing showing a coating device of lubricant in accordance with an embodiment of the invention.

FIG. 15 is a partial perspective drawing showing a coating device 70 for coating lubricant, which corresponds to the coating device 70 in FIG. 2. As shown in FIG. 2 and FIG. 15, the coating device 70 is separately mounted on cleaning module 20. The coating device 70 includes film forming member 71 to form a film on photoconductive drum 10, a supplying member 72 with film 721 which is rotated in a same direction at a contact portion to supply lubricant on the photoconductive drum 10. A lubricant accommodating portion 270 is also formed in a process cartridge frame 210 to accommodate lubricant. For another embodiment, a supplying member 72 can use a brush member. The film 721 is preferably selectable from a polyester resin, a fluorine resin, a styrene resin, acryl resin and so on. The brush may be selectable from the same, and polyamide resin, e.g. nylon and the like. Also, to prevent electrical charging by friction, a carbon black (e.g. acetylene black, furnace black), or a metal powder (e.g. graphite, copper, silver) can be included in the lubricant. Electrical resistance of the lubricant is preferably from $10^2$ to $10^8$ ohm cm. A film forming member 71 includes a coating blade 711 and a coating blade supporting member 712. The coating blade may be made of elastomer of fluorine resin, urethane resin, or silicon resin. Especially, urethane resin is preferable because of its high elasticity and low abrasion. The coating blade supporting member 712 may have a foaming member to retain the coating blade 711. The foaming member may be made of silicon resin, fluorine resin, or urethane resin. Especially, urethane resin is preferable to prevent or reduce abrasion of photoconductive drum 10 and to uniformly form a film.

A direction that a coating blade 711 contacts on a photoconductive drum 10 is selectable from a counter direction or a treading direction. The counter direction means that an edge portion of a blade can dam up on a photoconductive drum. And the treading direction means that a side of a blade is pressed on a photoconductive drum. It is acceptable if an edge of the coating blade 711 is hard to reverse so that it uniformly coats lubricant on a photoconductive drum 10. A pressure of the coating blade 711 may be from 5 to 30 N/cm, and an angle may be from 10 to 30 degrees. Other conditions, e.g. a free length of blade, could be decided by elasticity of each blade. Further, pressure of the coating blade 711 is preferably less than a cleaning blade 22, because the coating blade 711 coats lubricant.

The coating device 70 coats lubricant on a photoconductive drum 10 by a film 721 of supplying member 72 conveying the lubricant on the photoconductive drum 10, and then a coating blade 711 uniformly forming a film on the photoconductive drum 10. As such, a friction value of the photoconductive drum 10 is reduced so that a transfer efficiency of toner is higher and residual toner is reduced.

Also, as a friction value of the photoconductive drum 10 is reduced, it is possible to remove toner having a high circularity, which is generally hard to be removed. Further, since coating blade 711 forms film, the coating blade 711 preferably dams too much lubricant so that film can be formed as a minimum thickness. In such case, lubricant not to be coated on the photoconductive drum is returned to a lubricant accommodating portion 270 so that the lubricant is not wasted.

The lubricant may be fatty metal oxide salts such as lead oleic acid, zinc oleic acid, copper oleic acid, zinc stearate, cobalt stearate, iron stearate, copper stearate, zinc palmitic acid, copper palmitic acid and zinc linolenic acid. The lubricant may also be fluorine-based resins such as polytetrafluoroethylene, polychlorotrifluoroethylene, polyfluoridevinylidene, polytrifluorochlorethylene, dichlorodifluoroethylene, tetrafluoroethylene-ethylne copolymer and tetrafluoroethylene-oxafluoropolypyrene copolymer. From the point of view of the large effect of reducing the friction of the photoconductive drum 10, the lubricant is preferably metal oxide salt stearate, and more preferably zinc stearate. In this embodiment, lubricant is used as powder, and a volume average particle size of the lubricant has a range from 0.1 to 3.0 mm. If the lubricant is formed as a block, it is necessary to strongly brush the block of lubricant to a powder condition, and then convey it onto the photoconductive drum 10. Therefore, a lifetime of the brush may be short, and the brush may need a higher strength driving axis or a gear to drive it. Further, it may be hard to reduce costs for manufacture of such an embodiment. However, this embodiment easily forms a film on the photoconductive drum 10 by a coating blade 711 because lubricant is formed as powder having a volume average particle size that is small. If a volume average particle size is less than 0.1 mm, lubricant may pass through a coating blade 711. Also, if a volume average particle size is over than 3.0 mm, lubricant may be dammed by a coating blade 711 so that film is not formed.

Figure 16A:
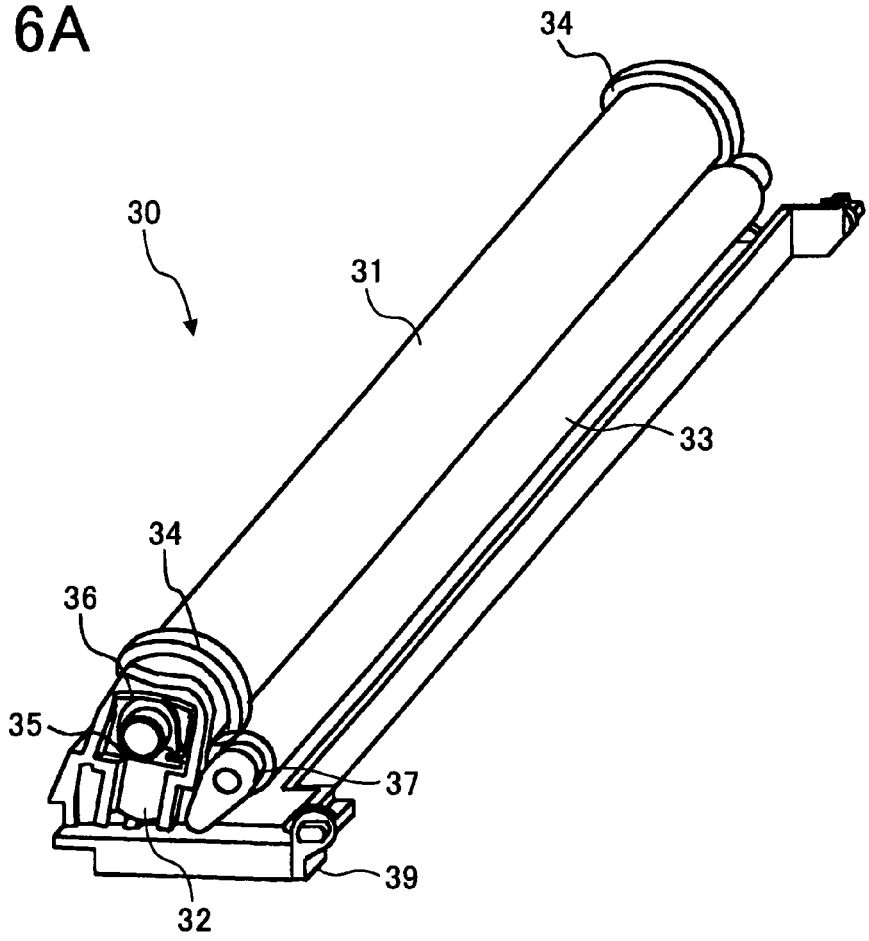
FIG. 16(A) is a perspective drawing showing a charging module.
Figure 16B:
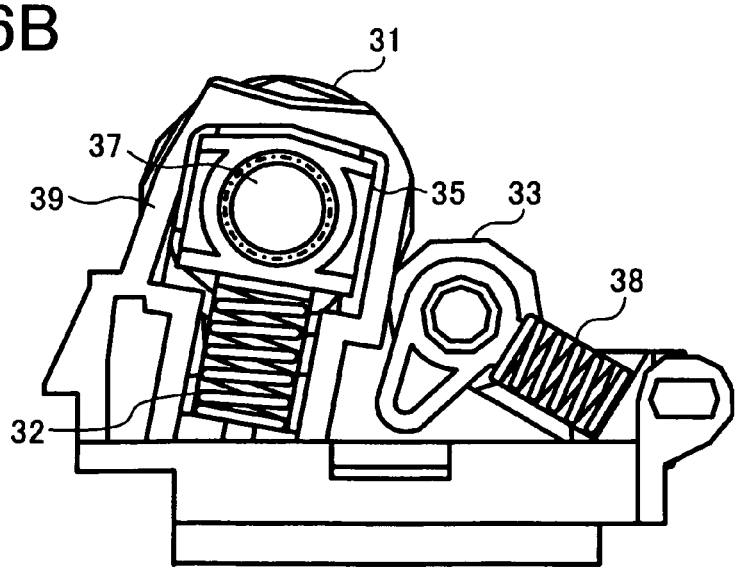
FIG. 16(B) is a sectional drawing showing the charging module in accordance with an embodiment of the invention.

FIG. 16(A) is a perspective drawing of a charging module 30, and FIG. 16(B) is a sectional drawing of the charging module 30 in accordance with an embodiment of the invention. As shown FIG. 16(A), a charging module 30 includes a charging member 31 configured to face a photoconductive drum 10 when the charging module 39 is installed in a process cartridge 200, a gear 36 fixed at end portion of the charging member 31 (not shown), and a spring member 32 to prevent vibration of the charging member 31. Also included is a charging member cleaning roller 33 to remove dirt of the charging member 31, a bearing 37 to retain the charging member cleaning roller 33, a spring member 38 to press the charging member cleaning roller 33 to the charging member 31, a spacer member 34 to make a gap between the charging member 31 and the photoconductive drum 10, a supporting member 35 mounted at end portion of the charging member 31 to retain the charging member 31 in a housing 39 of the charging module 30, and a housing 39 to accommodate these inside. The gear 36 of the charging member 31 is rotatably driven by a driving mechanism as explained below, and the charging member cleaning roller 33 is preferably supported to rotate together with the charging member 31. The supporting member 35 is pressed by the spring member 32 in a leaving direction (i.e. toward an axis of the photoconductive drum 10), and a restricting member formed in the housing 39 restricts movement of the supporting member 35. According to such embodiment, when a charging module 30 is mounted on process cartridge 200, a charging member 31 is pressed to face a photoconductive drum 10 with a proper gap by a spacer member 34. Further, after the charging module 30 is removed from the process cartridge 200, the charging module 30 can easily be handled or carried by a user or a service person. In this embodiment, a charging member 31 is driven by a driving mechanism; however, it is also possible that a charging member is rotated by contact with a photoconductive drum 10.

Figure 17A:
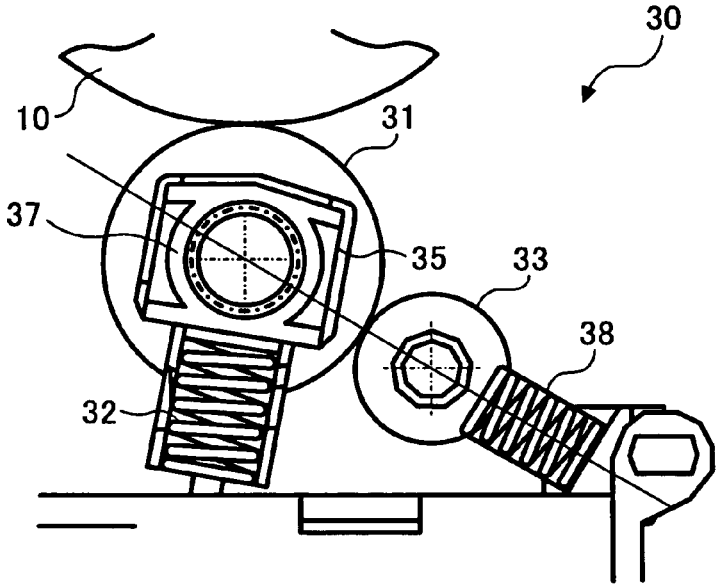
FIG. 17(A) is an explanatory diagram of a charging module when mounted on a process cartridge.
Figure 17B:
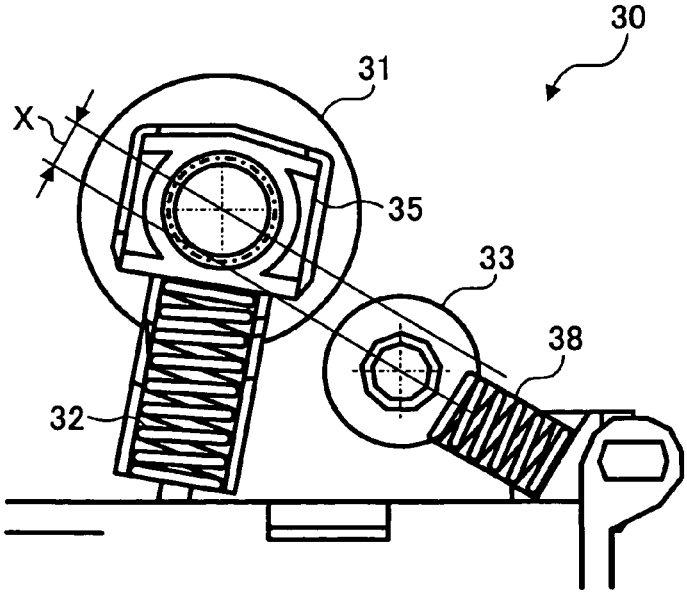
FIG. 17(B) is an explanatory diagram of the charging module after removed from the process cartridge in accordance with an embodiment of the invention.

FIG. 17(A) is an explanatory diagram showing a charging module 30 when mounted on a process cartridge 200 in accordance with an embodiment of the invention. FIG. 17(B) is an explanatory diagram showing a charging module 30 after removed from a process cartridge 200. As shown, when a charging module 30 is removed from a process cartridge 200, a direction that a charging member cleaning roller 33 is pressed by a spring member 38, is offset (to a distance X shown in FIG. 17(B)) from a center of the charging member 31 when the charging module 30 is mounted on the process cartridge 200. Therefore, before charging module 30 is mounted on a process cartridge 200, a deformation of a charging member cleaning roller 33 is reduced because a pressure by a spring member is less. Further, after a charging module 30 is mounted on a process cartridge 200, a charging member 31 is pressed by a photoconductive drum 10 and then a spring member 32 is compressed, so that the charging member cleaning roller 33 is pressed toward a center of a charging member 31. Therefore, a charging member cleaning roller 33 can properly contact charging member 31 by a pressure of spring member 38, so that a cleaning ability can be improved.

Figure 18:
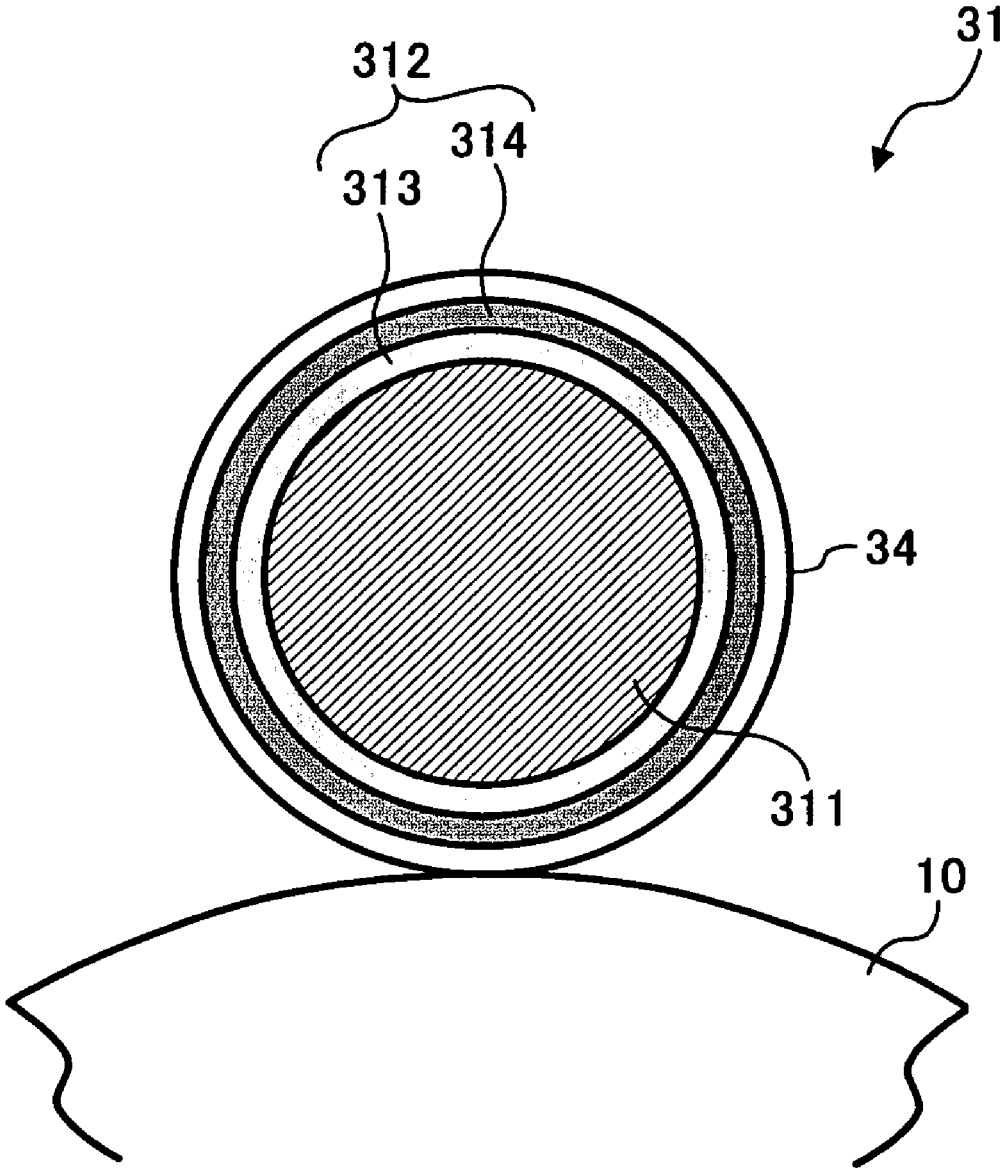
FIG. 18 is a diagram showing general structure of a charging member in accordance with an embodiment of the invention.

FIG. 18 is a diagram showing a general structure of a charging member 31. The charging member 31 of the charging module 30 may have any suitable structure, but the roller shape is preferable. The charging member 31 shown in FIG. 18 includes a shaft part 311 made of a core metal and provided at the center, and a main body part 312. The main body part 312 is made up of an intermediate resistor layer 313 provided around the shaft part 311, and a surface layer 314 provided around the intermediate resistor layer 313 and forming the outermost layer. For example, the shaft part 311 is made of a metal, such as stainless steel and aluminum, having a high rigidity and high conductivity, with a diameter of 8 mm to 20 mm. Alternatively, the shaft part 311 is made of a conductive resin or the like having a high rigidity and a volume resistivity of 1×103 Ω·cm or less, and preferably 1×102 Ω·cm or less.

Preferably, the intermediate resistor layer 313 has a thickness in a range of approximately 1 mm to 2 mm and a volume resistivity in a range of 1×105 Ω·cm to 1×109 Ω·cm. Preferably, the surface layer 314 has a thickness of approximately 1 μm and a volume resistivity in a range of 1×106 Ω·cm to 1×1012 Ω·cm. It is further preferable that the volume resistivity of the surface layer 314 is higher than the electrical resistivity of the intermediate resistor layer 313. Although the main body part 312 of this embodiment has a two-layer structure made up of the intermediate resistor layer 313 and the surface layer 314, the main body part 312 is of course not limited to such a structure, and the main body part 312 may be formed by a single-layer structure or a multi-layer structure such as a three-layer structure. In this embodiment, a charging member cleaning roller 33 is made of foaming resin, e.g. meramin foam. However, it would be possible to use a brush, a roller or the like.

In this embodiment, a gap between a charging member 31 and a photoconductive drum 10 is a range between 20 and 50 mm, so that an error of forming an image can be reduced. The gap may be adjusted by an adjusting portion formed on the process cartridge frame 210 which mounts both the process cartridge 200 and charging module 30. Further, if a charging roller 31 is pressed spring member 32 mounting a bearing having a lower friction resin, a certain gap can be kept in spite of vibration or error by manufacture.

Figure 19:
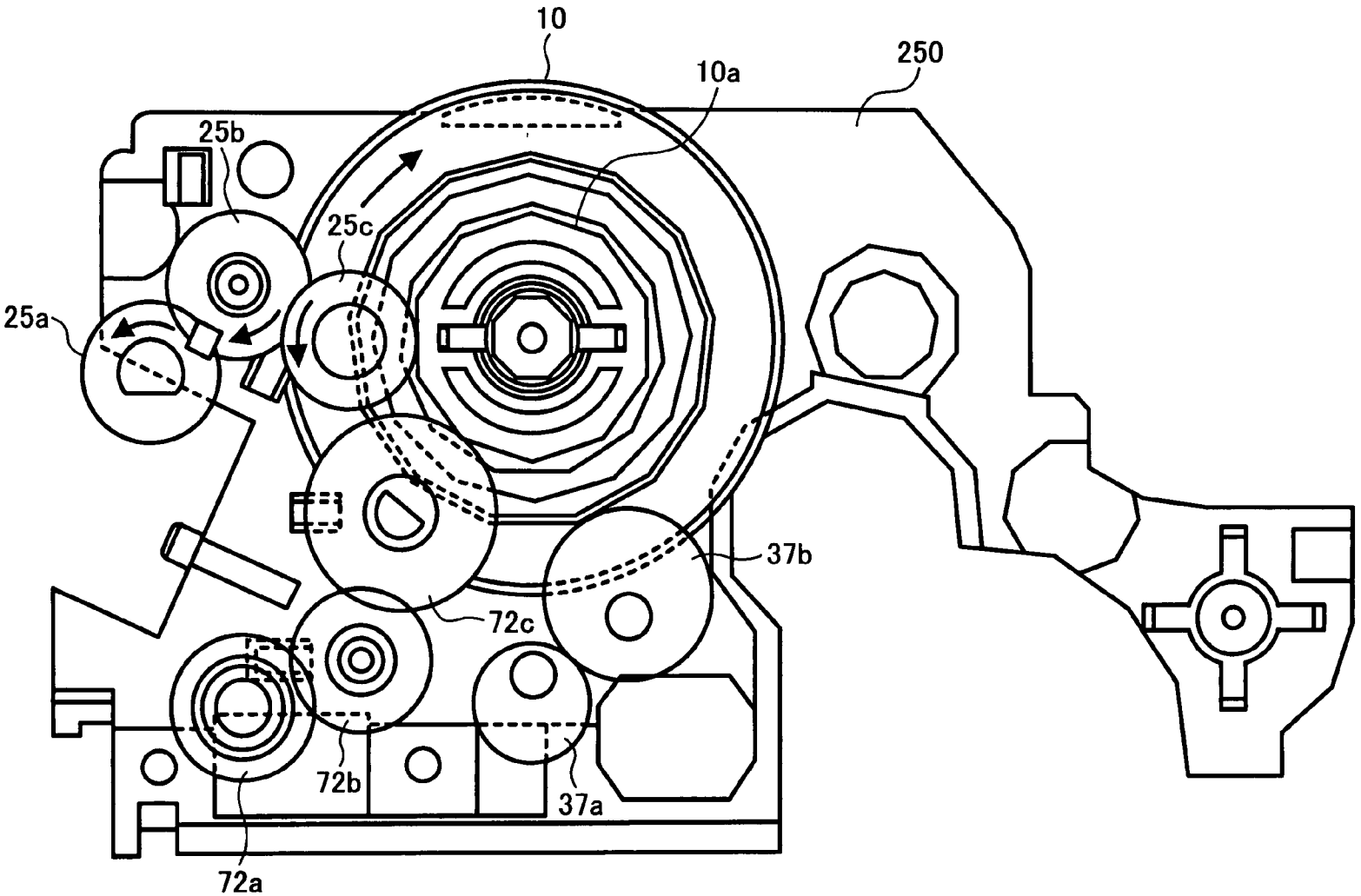
FIG. 19 is a partial sectional drawing showing gears mounted inside of a side plate in accordance with an embodiment of the invention.

FIG. 19 is a partial sectional drawing showing gears mounted inside of a side plate 250. As explained above, photoconductive drum 10 is rotatably driven from a main body of an image forming apparatus 100. A photoconductive drum gear 10*a* mounted in a rotatable an axis 14 of the photoconductive drum 10 gears with conveying auger gear 25*a*, 25*b*, 25*c*, and rotates conveying auger 25. Thus, the conveying auger 25 is rotated can convey a residual toner accommodated inside of a housing 26 of a cleaning module 20 to outside a process cartridge. Further, the photoconductive drum gear 10*a* gears with supplying gear 72*a*, 72*b*, 72*c*, and rotates supplying member 72 so that it can supply lubricant on the photoconductive drum 10. Further, the photoconductive drum gear 10*a* gears a charging member gear, and rotates a charging member 31 so that it can uniformly charge on photoconductive drum 10.

In this embodiment, a rotation speed of the supplying member 72 is faster than that of the photoconductive drum 10. Therefore, the supplying member 72 can supply sufficient lubricant on the photoconductive drum 10. The speed of the supplying member is also adjustable by a change of gears, so that it can supply adequate lubricant on a photoconductive drum 10.

A process cartridge 200 can include sensors, e.g. a temperature humidity sensor to detect temperature and humidity inside a process cartridge 200, a potential sensor to detect potential on photoconductive drum 10, a toner density sensor to detect a toner density developed on a photoconductive drum 10, and the like. Further, it is possible to use an electrical discharging device before transferring, or before cleaning.

A process cartridge 200 collectively includes at least a photoconductive drum 10 and a cleaning blade 21 as a cleaning device, and can be detachably mounted in an image forming apparatus 100. The process cartridge 200 can accurately assemble a cleaning blade 21 so that a cleaning ability can be improved. Further, since a process cartridge 200 is accurately assembled with less bending and/or less twisting, the other modules can be accurately assembled. Therefore, a developing module 50 can be accurately mounted in the process cartridge 200 so that accuracy between the developing module 50 and the photoconductive drum 10 can be higher, and a higher quality image can be formed. Also, since position accuracy between charging module 30 and a photoconductive drum 10 can be improved, charging disposal can be reduced and a lifetime of the photoconductive drum can be longer. Also, since accuracy between cleaning blade 21 and photoconductive drum 10 can be higher, noise during forming an image can be reduced. Also, since an image forming apparatus 100 uses a process cartridge 200 as explained above, a higher quality image can be formed during a longer term.

A toner used by an image forming apparatus 100 is now explained. To form a fine dot over 600 dpi, a volume average particle size of a toner is preferably in a range of 3 to 8 mm. A particle size distribution described by a ratio (Dv/Dn) of the volume average particle size Dv and a number average particle size Dn is preferably in a range of 1.00 to 1.40. If the (Dv/Dn) is close to 1.00, the particle size distribution is narrow. By narrowing the particle size distribution, the charging distribution of the toner becomes uniform so that a higher quality image can be formed. Further, transfer efficiency is higher in an electrostatic image transfer system.

Figure 20A:
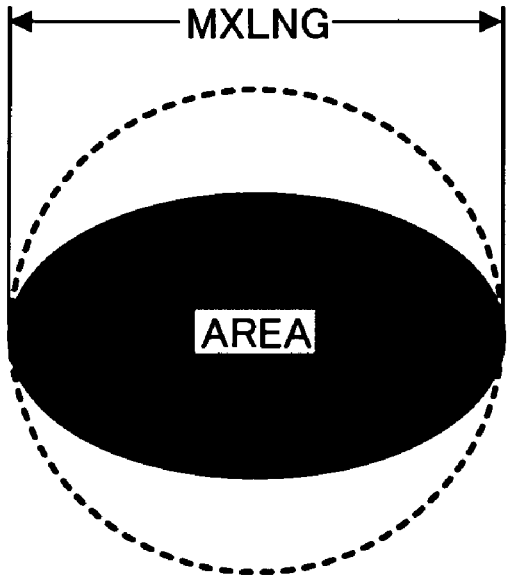
FIG. 20(*a*) and FIG. 20(*b*) are diagrams showing toner shapes for explaining a shape factor SF-1 and a shape factor SF-2.
Figure 20B:
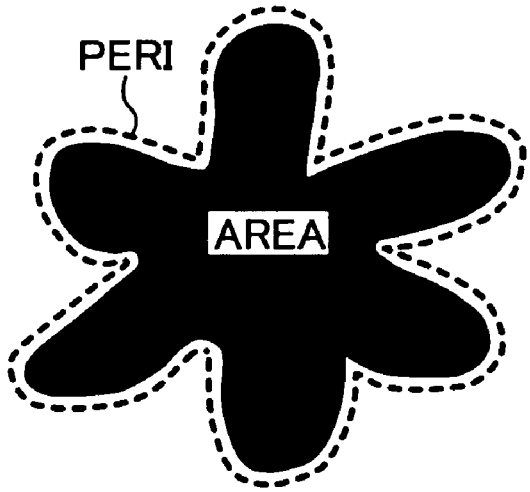

Of the circularity, it is preferable that the toner has a shape factor SF-1 in a range greater than or equal to 100 and less than or equal to 180, and a shape factor SF-2 in a range greater than or equal to 100 and less than or equal to 180. FIG. 20(*a*) and FIG. 20(*b*) respectively are diagrams showing toner shapes for explaining a shape factor SF-1 and a shape factor SF-2. The shape factor SF-1 indicates a proportion of circularity of the toner particle and is represented by the following formula (1). A square of a maximum length MXLNG of the shape obtained by projecting the toner particle in a two-dimensional plane, is divided by a graphic area AREA and is then multiplied by 100Π/4 to obtain the value of the shape factor SF-1.

$$SF\text{-}1=\{(MXLNG)2/\mathrm{AREA}\}\times(100\Pi/4) \quad (1)$$

When the value of SF-1 is equal to 100, the shape of the toner particle is perfectly circular, and as the value of SF-1 increases, the shape becomes more indefinite.

The shape factor SF-2 indicates a proportion of surface unevenness of the toner particle and is represented by the following formula (2). A square of a periphery PERI of the shape obtained by projecting the toner particle in a two-dimensional plane is divided by a graphic area AREA and is then multiplied by 100Π/4 to obtain the value of the shape factor SF-2.

$$SF\text{-}2=\{(PERI)2/\mathrm{AREA}\}\times(100\Pi/4) \quad (2)$$

When the value of SF-2 is equal to 100, there is no unevenness on the surface of the toner particle, and as the value of SF-2 decreases, the surface unevenness of the toner particle becomes more conspicuous.

The shape factor can be measured by taking a picture of the toner particle with a scanning electron microscope (S-800 manufactured by HITACHI SEISAKUSHO), analyzing it with an image analyzer (LUSEX3 manufactured by NIRECO CO., LTD.), and calculating the shape factor.

The toner particles preferably have the shape factor SF-1 in a range of 100 to 180 and the shape factor SF-2 in a range of 100 to 180. When the shape of the toner particles is closer to the circular shape, the contact of the toner particle with other toner particle or the contact of the toner particle with the photoconductive drum 10 is a point contact, which improves the fluidity of the toner. Thus, the mutual adhesion of toner particles weakens and the fluidity is improved, thereby improving the transfer efficiency and facilitating the cleaning of the residual toner on the photoconductive drum 10.

The application claims priority to Japanese patent application nos. 2004-060512 and 2004-121-93, filed on Mar. 4, 2004 and Apr. 16, 2004, the disclosures of which are incorporated by reference herein in their entirety.

The invention claimed is:

1. A process cartridge configured to be detachably mounted in an image forming apparatus, comprising:

a photoconductive member comprising a shaft positioned along an axis of the photoconductive member;

a cleaning member;

a supporting member in contact with said cleaning member; and first and second plates positioned on opposing ends of the photoconductive member, each plate comprising:

a bearing member positioned on a bearing surface of the plate that is substantially perpendicular to the axis of the photoconductive member such that each bearing member is configured to retain a respective end of said shaft of said photoconductive member, and a contacting surface provided on a periphery of the plate in a plane that intersects the bearing surface such that each contacting surface is configured to retain a respective end of said supporting member that is in contact with the cleaning member.

2. The process cartridge as claimed in claim 1, wherein said cleaning member comprises a cleaning blade.

3. The process cartridge as claimed in claim 2, wherein said supporting member is further configured to support a housing that accommodates a residual toner inside.

4. The process cartridge as claimed in claim 1, wherein said contacting surfaces and said cleaning member contact a same side of said supporting member.

5. The process cartridge as claimed in claim 2, further comprising a coating device configured to coat lubricant on said photoconductive member.

6. The process cartridge as claimed in claim 5, wherein said lubricant is formed as powder.

7. The process cartridge as claimed in claim 6, wherein said coating device further comprises a coating blade formed of elastomer.

8. The process cartridge as claimed in claim 1, wherein said first and second plates comprise separate parts.

9. The process cartridge as claimed in claim 1, wherein said bearings are positioned near said contacting surfaces.

10. The process cartridge as claimed in claim 1, further comprising:

a charging device configured to charge said photoconductive member; and a developing device configured to develop a latent image on said photoconductive member.

11. The process cartridge as claimed in claim 10, wherein each of said charging device and said developing device is formed as a module.

12. The process cartridge as claimed in claim 11, wherein a cleaning module comprises said cleaning member and said supporting member.

13. The process cartridge as claimed in claim 12, wherein said cleaning module further comprises a housing configured to accommodate a residual toner.

14. An image forming apparatus, comprising:

a photoconductive member comprising a shaft positioned along an axis of the photoconductive member;

a cleaning member;

a supporting member in contact with said cleaning member and configured to support said cleaning member to contact on said photoconductive member; and a process cartridge frame having first and second plates positioned on opposing ends of the photoconductive member, each plate comprising:

a bearing member positioned on a bearing surface of the plate that is substantially perpendicular to the axis of the photoconductive member such that each bearing member is configured to retain a respective end of said shaft of said photoconductive member, and a contacting surface provided on a periphery of the plate in a plane that intersects the bearing surface such that each contacting surface is configured to retain a respective end of said supporting member that is in contact with the cleaning member.

15. The apparatus as claimed in claim 14, wherein said cleaning member comprises a cleaning blade.

16. The apparatus as claimed in claim 15, wherein said supporting member is further configured to support a housing that accommodates a residual toner inside.

17. The apparatus as claimed in claim 14, wherein said contacting surfaces and said cleaning member contact a same side of said supporting member.

18. The apparatus as claimed in claim 15, further comprising a coating device configured to coat lubricant on said photoconductive member.

19. The apparatus as claimed in claim 18, wherein said lubricant is formed as powder.

20. The apparatus as claimed in claim 19, wherein said coating device further comprises a coating blade formed of elastomer.

21. The apparatus as claimed in claim 14, wherein said first and second plates comprise separate parts.

22. The apparatus as claimed in claim 14, wherein said bearings are positioned near said contacting surfaces.

23. The apparatus as claimed in claim 14, further comprising:

a charging device configured to charge said photoconductive member; and a developing device configured to develop a latent image on said photoconductive member.

24. The apparatus as claimed in claim 23, wherein each of said charging device and said developing device is formed as a module.

25. The apparatus as claimed in claim 24, wherein a cleaning module comprises said cleaning member and said supporting member.

26. The apparatus as claimed in claim 25, wherein said cleaning module further comprises a housing configured to accommodate a residual toner.

27. The apparatus as claimed in claim 14, further comprising a toner having a volume average particle size in a range of approximately 3 to 8 mm.

28. The apparatus as claimed in claim 27, wherein a ratio (Dv/Dn) of the volume average particle size Dv and a number average particle size Dn of said toner is in a range of approximately 1.00 to 1.40.

29. The apparatus as claimed in claim 14, further comprising a toner, wherein a shape factor SF-1 of the toner is in a range of 100 to 180, and a shape factor SF-2 of the toner is in a range of 100 and 180.

30. A process cartridge configured to be detachably mounted in an image forming apparatus, comprising:

a photoconductive member comprising a shaft-positioned along an axis of the photoconductive member;

a cleaning member;

a supporting member in contact with said cleaning member; and first and second plates positioned on opposing ends of the photoconductive member, each plate comprising:

a bearing member positioned on a bearing surface of the plate that is substantially perpendicular to the axis of the photoconductive member such that each bearing member retains a respective end of the shaft of the photoconductive member, and a contacting surface provided on a periphery of the plate in a plane that intersects the bearing surface such that each contacting surface retains a respective end of the supporting member, wherein the first and second plates are configured to determine a position of said supporting member relative to said photoconductive member.

31. The process cartridge of claim 30, wherein ends of said supporting member directly connect said first and second side plates respectively.

32. The process cartridge of claim 31, wherein said supporting member comprises an L shaped part having a substantially straight segment configured to support the cleaning member.

33. The process cartridge of claim 32, wherein said substantially straight segment comprises multiple layers.

34. A process cartridge configured to be detachably mounted in an image forming apparatus, comprising:

a photoconductive member having an axis;

a cleaning member;

a supporting member in contact with the cleaning member and configured to support said cleaning member in contact with the photoconductive member; and means for retaining said axis of said photoconductive member and determining a position of said supporting member relative to said photoconductive member to accurately position the cleaning member in contact with the photoconductive member.

35. The process cartridge of claim 1, wherein each of the first and second plates further comprises an alignment projection provided on the contacting surface, and wherein the supporting member further comprises recesses configured to receive a respective one of the alignment projection provided on the contacting surface.

36. The process cartridge of claim 14, wherein each of the first and second plates further comprises an alignment projection provided on the contacting surface, and wherein the supporting member further comprises recesses configured to receive a respective one of the alignment projection provided on the contacting surface.

37. The process cartridge of claim 30, wherein each of the first and second plates further comprises an alignment projection provided on the contacting surface, and wherein the supporting member further comprises recesses configured to receive a respective one of the alignment projection provided on the contacting surface.

* * * * *